US006708015B2

(12) United States Patent
Kurosu et al.

(10) Patent No.: US 6,708,015 B2
(45) Date of Patent: Mar. 16, 2004

(54) DEVELOPING DEVICE AND IMAGE FORMING APPARATUS USING THE SAME

(75) Inventors: Hisao Kurosu, Yokohama (JP); Shigekazu Enoki, Kawasaki (JP); Chikara Imai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 103 days.

(21) Appl. No.: 10/098,591

(22) Filed: Mar. 18, 2002

(65) Prior Publication Data

US 2002/0146632 A1 Oct. 10, 2002

(30) Foreign Application Priority Data

| | | |
|---|---|---|
| Mar. 16, 2001 | (JP) | 2001-076282 |
| Jun. 14, 2001 | (JP) | 2001-180898 |
| Jul. 2, 2001 | (JP) | 2001-200980 |
| Mar. 6, 2002 | (JP) | 2002-060870 |

(51) Int. Cl.[7] ..... G03G 15/09

(52) U.S. Cl. ..... 399/267; 399/53; 430/111.41; 430/122

(58) Field of Search ..... 399/267, 252, 399/266, 265, 270, 276, 277, 53, 55; 430/122, 120, 111.41

(56) References Cited

U.S. PATENT DOCUMENTS

| | | | | |
|---|---|---|---|---|
| 5,172,169 | A | 12/1992 | Takashima et al. | 399/281 |
| 5,220,383 | A | 6/1993 | Enoki et al. | 399/285 |
| 5,227,842 | A | 7/1993 | Hayashi et al. | 399/55 |
| 5,239,344 | A | 8/1993 | Enoki et al. | 399/285 |
| 5,245,391 | A | 9/1993 | Suzuki et al. | 399/285 |
| 5,270,783 | A | 12/1993 | Bisaiji et al. | 399/62 |
| 5,286,918 | A | 2/1994 | Iwata et al. | 399/119 |
| 5,311,263 | A | 5/1994 | Suzuki et al. | 399/276 |
| 5,384,628 | A | 1/1995 | Takami et al. | 399/255 |
| 5,389,733 | A | 2/1995 | Enoki et al. | 399/104 |
| 5,394,231 | A | 2/1995 | Sudo et al. | 399/228 |
| 5,451,713 | A | 9/1995 | Suzuki et al. | 399/285 |
| 5,474,869 | A | 12/1995 | Tomita et al. | 430/102 |
| 5,508,794 | A | 4/1996 | Ikesue et al. | 399/120 |
| 5,627,630 | A | 5/1997 | Matsumae et al. | 399/26 |
| 5,671,470 | A | 9/1997 | Maruta et al. | 399/235 |
| 5,674,408 | A | 10/1997 | Suzuki et al. | 216/39 |
| 5,724,634 | A | 3/1998 | Maruta | 399/227 |
| 5,741,616 | A | 4/1998 | Hirano et al. | 430/101 |
| 5,819,145 | A | 10/1998 | Tanaka et al. | 399/274 |
| 5,826,146 | A | 10/1998 | Maruta et al. | 399/235 |

(List continued on next page.)

FOREIGN PATENT DOCUMENTS

| | | |
|---|---|---|
| JP | 05-303284 | 11/1993 |
| JP | 06-324571 | 11/1994 |
| JP | 08-044194 | 2/1996 |
| JP | 11-338259 | 12/1999 |
| JP | 2000-305360 | 11/2000 |
| JP | 2000-305361 | 11/2000 |

*Primary Examiner*—Sophia S. Chen
(74) *Attorney, Agent, or Firm*—Oblon, Spivak, McClelland, Maier & Neustadt, P.C.

(57) ABSTRACT

A developing method of the present invention develops a latent image formed on an image carrier with a two-ingredient type developer, which consists of toner grains and magnetic carrier grains for supporting the toner grains. A developer carrier faces the image carrier and accommodates magnetic field forming device therein for causing the developer to deposit on the developer carrier. The developer is conveyed to a developing zone formed between the image carrier and the developer carrier. The latent image is developed by a magnet brush including free toner grains, which part from brush chains formed by the carrier grains when the brush chains start rising on the developer carrier in the developing zone. The method insures a high-density, smooth solid image. A device for practicing the method is also disclosed.

66 Claims, 28 Drawing Sheets

U.S. PATENT DOCUMENTS

| | | | | |
|---|---|---|---|---|
| 5,835,825 | A | 11/1998 | Maruta | 399/227 |
| 5,860,038 | A | 1/1999 | Kato et al. | 399/49 |
| 5,864,733 | A | 1/1999 | Mae et al. | 399/46 |
| 5,881,334 | A | 3/1999 | Maruta et al. | 399/18 |
| 6,055,386 | A | 4/2000 | Kato et al. | 399/49 |
| 6,160,569 | A | 12/2000 | Fujimori et al. | 347/262 |
| 6,226,481 | B1 | 5/2001 | Yoneda et al. | 399/227 |
| 6,335,137 | B1 | 1/2002 | Suzuki et al. | 430/110.1 |
| 6,337,957 | B1 | 1/2002 | Tamaki et al. | 399/29 |
| 6,403,275 | B1 | 6/2002 | Kuramoto et al. | 430/111.4 |
| 6,442,364 | B2 | 8/2002 | Kai et al. | 399/277 |
| 6,468,706 | B2 | 10/2002 | Matsuda et al. | 430/108.6 |
| 6,507,718 | B2 | 1/2003 | Ohjimi et al. | 399/127 |
| 2002/0028093 | A1 * | 3/2002 | Miyoshi et al. | 399/267 |
| 2002/0141789 | A1 * | 10/2002 | Terai | 399/267 |

* cited by examiner

FIG. 13

| EX. & COMP. EX. | DEVELOPER | | PROCESS CONDITIONS | | | | |
|---|---|---|---|---|---|---|---|
| | GRAIN SIZE TOP : CARRIER BOTTOM : TONER (μm) | TONER CHARGE (μC/g) | MAIN POLE ANGLE (°) | Vs/Vp | PG (mm) | DG (mm) | TC (%) |
| EX. 1 | 50 μm PULVERIZED 7 μm | −25 | 0 | 1.4 | 0.6 | 0.65 | 7 |
| COMP. EX. 1 | 50 μm PULVERIZED 7 μm | −65 | +5 1) | 1.4 | 0.6 | 0.8 | 2 |

1) UPSTREM SIDE

FIG. 15

| EXs. & COMP. EXs. | DEVELOPER | PROCESS CONDITIONS | | | | |
|---|---|---|---|---|---|---|
| | GRAIN SIZE TOP : CARRIER BOTTOM : TONER (μm) | ELECTRIC FIELD (V) | Vs/Vp | PG (mm) | DG (mm) | TC (%) |
| EX. 2 | 50 μm PULVERIZED 7 μm | 250 | 1.4 | 0.6 | 0.65 | 7 |
| EX. 3 | 50 μm PULVERIZED 7 μm | 250 | 1.4 | 0.6 | 0.65 | 7 |
| COMP. EX. 2 | 50 μm PULVERIZED 7 μm | 250 | 1.4 | 0.6 | 0.65 | 7 |
| COMP. EX. 3 | 50 μm PULVERIZED 7 μm | 275 | 1.4 | 0.6 | 0.65 | 5 |

FIG. 16

| EXs. & COMP. EXs. | PRESENCE/ ABSENCE OF SHEET | AMOUNT OF TONER DEPOSITION | | | IMAGE QUALITY | | | |
|---|---|---|---|---|---|---|---|---|
| | | FREE TONER GRAINS $\alpha$ (mg /cm$^2$) | DEPOSITED TONER $\beta$ (mg /cm$^2$) | $\alpha/\beta$ (%) | UNIFORM DENSITY | BACK-GROUND CONTAMI-NATION | RESIDUAL IMAGE | OMISSION OF TEXT |
| EX. 2 | ABSENT | 0.7 | 0.7 | 100 | ◎ | ◎ | ◎ | ◎ |
| EX. 3 | 1/2 | 0.35 | 0.7 | 50 | ○ | ◎ | ○ | ○ |
| COMP. EX. 2 | PRESENT | 0 | 0.7 | 0 | × | ◎ | × | × |
| COMP. EX. 3 | 1/2 | 0.3 | 0.7 | 43 | ○ | ◎ | × | × |

FIG. 17

| EXs. & COMP. EXs. | DEVELOPER | PROCESS CONDITIONS | | | | |
|---|---|---|---|---|---|---|
| | GRAIN SIZE TOP : CARRIER BOTTOM : TONER (μm) | ELECTRIC FIELD (V) | Vs/Vp | PG (mm) | DG (mm) | TC (%) |
| EX. 4 | 35 μm POLYMERIZED 5 μm | 250 | 1.4 | 0.4 | 0.5 | 9 |
| EX. 5 | 35 μm POLYMERIZED 5 μm | 200 | 1.4 | 0.4 | 0.5 | 11 |
| COMP. EX. 4 | 35 μm POLYMERIZED 5 μm | 250 | 1.4 | 0.4 | 0.5 | 9 |
| COMP. EX. 5 | 35 μm POLYMERIZED 5 μm | 200 | 1.4 | 0.4 | 0.5 | 11 |

FIG. 18

| EXs. & COMP. EXs. | PRESENCE/ ABSENCE OF SHEET | AMOUNT OF TONER DEPOSITION | | | IMAGE QUALITY | | | |
|---|---|---|---|---|---|---|---|---|
| | | FREE TONER GRAINS $\alpha$ (mg /cm$^2$) | DEPOSITED TONER $\beta$ (mg /cm$^2$) | $\alpha/\beta$ (%) | UNIFORM DENSITY | BACK-GROUND CONTAMI-NATION | RESIDUAL IMAGE | OMISSION OF TEXT |
| EX. 4 | ABSENCE | 0.45 | 0.50 | 90 | ◎ | ◎ | ◎ | ◎ |
| EX. 5 | ABSENCE | 0.7 | 0.50 | 140 | ○ | ◎ | ○ | ○ |
| COMP. EX. 4 | PRESENCE | 0 | 0.50 | 0 | △ | ◎ | × | × |
| COMP. EX. 5 | PRESENCE | 0 | 0.50 | 0 | △ | ◎ | × | × |

FIG. 19

| EX. & COMP. EX. | DEVELOPER | PROCESS CONDITIONS | | | | |
|---|---|---|---|---|---|---|
| | GRAIN SIZE TOP : CARRIER BOTTOM : TONER (μm) | ELECTRIC FIELD (V) | Vs/Vp | PG (mm) | DG (mm) | TC (%) |
| EX. 6 | 35μm POLYMERIZED 5μm | 185 | 1.9 | 0.4 | 0.55 | 8 |
| COMP. EX. 6 | 35μm POLYMERIZED 5μm | 185 | 1.9 | 0.4 | 0.55 | 8 |
| COMP. EX. 7 | 35μm POLYMERIZED 5μm | 175 | 1.9 | 0.4 | 0.55 | 9 |
| COMP. EX. 8 | 35μm POLYMERIZED 5μm | 175 | 1.9 | 0.4 | 0.55 | 9 |

FIG. 20

| EX. & COMP. EXs. | GRAIN SIZE TOP : CARRIER BOTTOM : TONER (μm) | PRESENCE/ ABSENCE OF SHEET | AMOUNT OF TONER DEPOSITION | | | IMAGE QUALITY | | | |
|---|---|---|---|---|---|---|---|---|---|
| | | | FREE TONER GRAINS α (mg /cm²) | DEPOSITED TONER β (mg /cm²) | α / β (%) | UNIFORM DENSITY | BACK-GROUND CONTAMI-NATION | RESIDUAL IMAGE | OMISSION OF TEXT |
| EX. 6 | 35 μm POLYMERIZED 5 μm | ABSENCE | 0.98 | 0.50 | 196 | ◎ | ◎ | ◎ | ◎ |
| COMP. EX. 6 | 35 μm POLYMERIZED 5 μm | PRESENCE | 0 | 0.50 | 0 | ○ | ○ | ○ | × |
| COMP. EX. 7 | 35 μm POLYMERIZED 5 μm | ABSENCE | 1.1 | 0.50 | 220 | ○ | × | ◎ | ○ |
| COMP. EX. 8 | 35 μm POLYMERIZED 5 μm | PRESENCE | 0 | 0.50 | 0 | ○ | × | ◎ | × |

FIG. 22

| EXs. | DG/mm | PG/mm | BLACK SOLID IMAGE DEPOSITION | CARRIER DEPOSITION |
|---|---|---|---|---|
| EX. 7 | 0.05 | 0.5 | 0.4 | NOT OCCURRED |
| EX. 8 | 0.1 | 0.5 | 1.0 | NOT OCCURRED |
| EX. 9 | 0.2 | 0.5 | 1.1 | NOT OCCURRED |
| EX. 10 | 0.3 | 0.5 | 1.2 | NOT OCCURRED |
| EX. 11 | 0.65 | 0.5 | 1.3 | NOT OCCURRED |
| EX. 12 | 0.7 | 0.5 | 1.2 | OCCURRED |

FIG. 23

| REF.EX,EXs & COMP.EX | $\theta^{\circ}$ | SOLITARY DOT REPRODUCTION | BLACK SOLID IMAGE DENSITY |
|---|---|---|---|
| REF.EX. 1 | 2 | GOOD | 1.2 |
| EX. 13 | 5 | GOOD | 1.2 |
| EX. 14 | 10 | GOOD | 1.3 |
| EX. 15 | 15 | GOOD | 1.3 |
| EX. 16 | 20 | GOOD | 1.2 |
| COMP.EX. 9 | 0 | GOOD | 0.7 |

FIG. 24

| EXs. | MAGNETIZATION STRENGTH emu/g | BLACK SOLID IMAGE DENSITY | IMAGE ESTIMATION |
|---|---|---|---|
| EX. 17 | 35 | 1.1 | GOOD |
| EX. 18 | 50 | 1.2 | GOOD |
| EX. 19 | 60 | 1.3 | GOOD |
| EX. 20 | 90 | 1.3 | IMAGE EDGES LOST |
| EX. 21 | 100 | 1.1 | BRUSH MARKS OVER ENTIRE IMAGE |

FIG. 25

| EXs. | GRAIN SIZE (μm) | BLACK SOLID IMAGE DENSITY | IMAGE ESTIMATION |
|---|---|---|---|
| EX. 22 | 20 | 1.1 | WHITE SPOTS DUE TO CARRIER SCATTERING |
| EX. 23 | 25 | 1.2 | GOOD |
| EX. 24 | 50 | 1.2 | GOOD |
| EX. 25 | 90 | 1.3 | GOOD |
| EX. 26 | 105 | 1.0 | BLUR AT TRAILING EDGE OF SOLID IMAGE |

FIG. 27

| REF.EX,EXs & COMP.EX. | $\theta^{\circ}$ | SOLITARY DOT REPRODUCTION | BLACK SOLID IMAGE DENSITY | IMAGE ESTIMATION |
|---|---|---|---|---|
| REF.EX. 2 | 2 | GOOD | 1.2 | SOME BLUR AT TRAILING EDGE |
| EX. 27 | 5 | GOOD | 1.2 | GOOD |
| EX. 28 | 10 | GOOD | 1.3 | GOOD |
| EX. 29 | 15 | GOOD | 1.3 | GOOD |
| EX. 30 | 20 | GOOD | 1.2 | GOOD |
| COMP.EX. 10 | 0 | GOOD | 0.7 | TRAILING EDGE LOST |

FIG. 28

| EXs. & COMP. EX. | MAGNETIZATION STRENGTH emu/g | BLACK SOLID IMAGE DENSITY | IMAGE ESTIMATION |
|---|---|---|---|
| EX. 31 | 35 | 1.2 | GOOD |
| EX. 32 | 50 | 1.2 | GOOD |
| EX. 33 | 60 | 1.3 | GOOD |
| EX. 34 | 90 | 1.3 | GOOD |
| COMP.EX. 11 | 100 | 1.2 | BRUSH MARKS OVER ENTIRE IMAGE TRAILING EDGE LOST |

FIG. 29

| EXs. & COMP. EX. | GRAIN SIZE (μm) | SOLITARY DOT REPRODUCTION | BLACK SOLID IMAGE DENSITY | IMAGE ESTIMATION |
|---|---|---|---|---|
| EX. 30 | 20 | GOOD | 1.2 | WHITE SPOTS DUE TO CARRIER DEPOSITION & SCATTERING |
| EX. 31 | 25 | GOOD | 1.3 | GOOD |
| EX. 32 | 50 | GOOD | 1.3 | GOOD |
| EX. 33 | 90 | GOOD | 1.3 | GOOD |
| COMP.EX. 12 | 105 | GOOD | 1.1 | BLUR AT TRAILING EDGE OF SOLID IMAGE |

DEVELOPING DEVICE AND IMAGE FORMING APPARATUS USING THE SAME

BACKGROUND OF THE INVENTION

1. Field of the Invention

The present invention relates to a copier, printer, facsimile apparatus or similar electrophotographic image forming apparatus and more particularly to a developing device for use in an image forming apparatus.

2. Description of the Background Art

It is a common practice with an image forming apparatus to form a toner image with a photoconductive element and a developing device storing a developer. Today, a two-ingredient type developer, which is a toner and magnetic carrier mixture, is predominant over a single-ingredient type developer, i.e., toner because it makes color image formation easy. The two-ingredient type developer (simply developer hereinafter) is agitated and mixed in the developing device. As a result, toner grains are charged by friction and electrostatically deposited on carrier grains. A sleeve or developer carrier, which accommodates a magnet roller therein, magnetically attracts the carrier grains. The carrier grains deposited on the sleeve are conveyed in accordance with the rotation of the sleeve.

More specifically, the magnet roller has a main magnet for development located at a position where the sleeve is closest to the photoconductive element. When the developer approaches the main magnet, the carrier grains of the developer gather and form so-called brush chains, which constitute a magnet brush. Generally, it is considered that the carrier grains, which are a dielectric, intensify field strength between the photoconductive element and the sleeve and thereby release the toner grains from the tips of the brush chains. This is why conventional development does not use portions where brush chains are absent. More specifically, the toner grains are transferred from the brush chains to the photoconductive element only in a limited range. It has therefore been extremely difficult to increase the amount of toner grains available for development in relation to the adjustment of the other process conditions for development.

Japanese Patent No. 2,668,781, for example, proposes a developing method for implementing a high-density image in the limited range mentioned above. The developing method transfers both of toner grains deposited on brush chains of magnetic grains and toner grains deposited on a developer carrier to a photoconductive element by using an alternating electric field. However, this method limits a developing zone to a range in which magnetic grains rub against a photoconductive element. It is therefore difficult to achieve sufficiently high image density only with the toner grains deposited on the brush chains and those deposited on the developer carrier. Further, an electrode effect cannot easily implement a smooth solid image because the number of brush chains is small. Moreover, the electric field causes the toner grains deposited on the magnetic grains to move toward the sleeve and contaminate the sleeve. The contamination of the sleeve makes the electric field for development different from surrounding electric fields, causing a residual image to appear in a halftone image.

Japanese Patent Laid-Open Publication Nos. 6-208304 and 7-319174, for example, each disclose a particular developing device constructed to deposit magnetic toner grains on a photoconductive element beforehand and then remove excess toner, thereby increasing image density while reducing fog. In such a developing device, the photoconductive element accommodates a magnet. The magnetic toner grains deposited on the photoconductive element are brought into contact with an electrode roller, which also accommodates a magnet, so that needless toner grains are removed from non-image portions. A problem with this kind of developing device is that even the photoconductive element must accommodate a magnet therein. Moreover, the developing device is high cost because it is operable only with magnetic toner, and is not feasible for color image formation.

Further, Japanese Patent Laid-Open Publication No. 5-46014 teaches a developing device in which a first developing roller develops a latent image, and then a second developing roller supplied only with magnetic carrier grains removes excess toner grains. This developing device not only needs two developing rollers, but also must continuously feed only fresh carrier grains, also resulting in an increase in cost.

Technologies relating to the present invention are also disclosed in, e.g., Japanese Patents 2,668,781, 2,850,504, 3,015,116, 3,023,999, 3,077,235 and 3,084,465, Japanese Patent Publication No. 8-44214, and Japanese Patent Laid-Open Publication Nos. 60-176069, 2-173684, 5-303284, 6-324571, 8-44194, 8-44214, 8-278691, 11-338259, 2000-305360 and 2000-305361.

SUMMARY OF THE INVENTION

It is an object of the present invention to provide a developing method capable of broadening a developing zone by causing the entire sleeve to contribute to development, thereby implementing a high density, smooth solid image, and a device for practicing the same.

It is another object of the present invention to provide a developing method capable of reducing the background contamination of an image by causing the brush chains of magnetic grains to collect toner grains from the non-image portions of a photoconductive element.

A developing method of the present invention develops a latent image formed on an image carrier with a two-ingredient type developer, which consists of toner grains and magnetic carrier grains for supporting the toner grains. A developer carrier faces the image-carrier and accommodates magnetic field forming means therein for causing the developer to deposit on the developer carrier. The developer is conveyed to a developing zone formed between the image carrier and the developer carrier. The latent image is developed by a magnet brush including free toner grains, which part from brush chains formed by the carrier grains when the brush chains start rising on the developer carrier in the developing zone.

A device for practicing the above developing method is also disclosed.

BRIEF DESCRIPTION OF THE DRAWINGS

The above and other objects, features and advantages of the present invention will become more apparent from the following detailed description taken with the accompanying drawings in which:

FIG. 13 is a table listing developers and process conditions used in Example 1 of a first embodiment of the present invention and Comparative Example;

FIG. 15 is a table listing developers and process conditions used in Examples 2 and 3 of the first embodiment and Comparative Examples 2 and 3;

FIG. 16 is a table listing the results of estimation effected with Examples 2 and 3 and Comparative Examples 2 and 3;

FIG. 17 is a table listing developers and process conditions used in Examples 4 and 5 of the first embodiment and Comparative Examples 4 and 5;

FIG. 18 is a table listing the results of estimation effected with Examples 4 and 5 and Comparative Examples 4 and 5;

FIG. 19 is a table listing developers and process conditions used in Example 6 of the first embodiment and Comparative Examples 6 through 8;

FIG. 20 is a table listing the results of estimation effected with Example 6 and Comparative Examples 6 through 8;

FIG. 22 is a table listing experimental results indicative of a relation between a doctor gap, a carrier grain size and a gap for development as determined with Examples 7 through 12 of a second embodiment of the present invention;

FIG. 23 is a table listing experimental results indicative of a relation between an angle between two particular positions, the reproducibility of solitary dots and the density of a black solid image as determined with Reference Example 1 and Examples 13 through 16 of the present invention and Comparative Example 9;

FIG. 24 is a table listing experimental results indicative of a relation between magnetization strength and the density of a black solid image together with the results of estimation as determined with Examples 17 through 21 of the second embodiment;

FIG. 25 is a table showing experimental results indicative of a relation between grain size and the density of a black solid image together with the results of estimation as determined with Examples 22 through 26 of the second embodiment;

FIGS. 27 through 29 are tables respectively corresponding to FIGS. 23 through 25 and showing experimental results particular to Reference Example 2 and Examples 27 through 34 of a third embodiment of the present invention and Comparative Examples 10 through 12.

DESCRIPTION OF THE PREFERRED EMBODIMENTS

Briefly, a developing method of the present invention forms a magnet brush, i.e., brush chains of magnetic carrier grains with toner deposited thereon and free toner grains separated from the brush chains.

Figure 1:
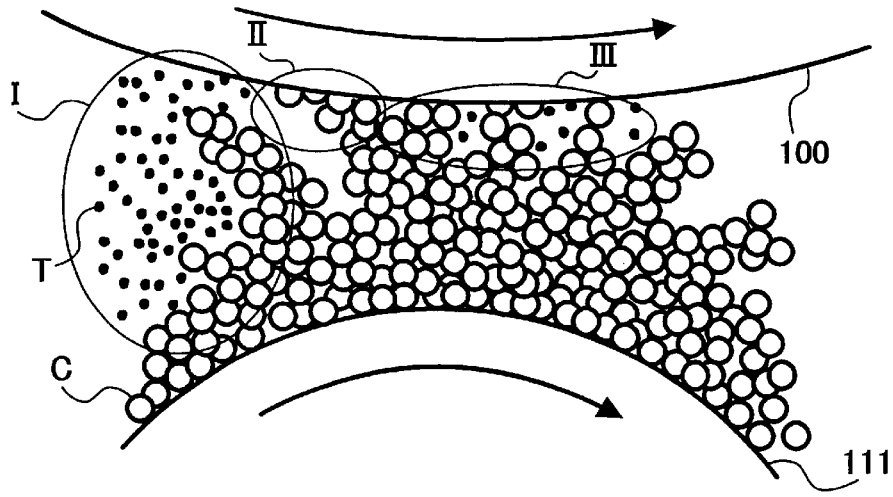
FIG. 1 shows how a developing method of the present invention causes toner grains and magnetic carrier grains behave in a developing zone.

FIG. 1 shows a magnet brush formed by a two-ingredient type developer in a developing zone in accordance with the present invention. As shown, a photoconductive element or image carrier implemented as a drum 100 and a sleeve or developer carrier 111 face each other. The developing zone refers to a range in which, whether magnetic carrier grains C may form brush chains or whether the developer may form a thin layer on the sleeve 111, toner grains T move toward the drum 100. In an upstream portion I of the developing zone, the carrier grains C approached a main magnet for development, not shown, form brush chains with toner grains T deposited thereon and start rising along the magnetic lines of force of the main magnet. A center portion II and a downstream portion III sequentially follow the upstream portion i.

Specifically, a plurality of magnets, not shown, are arranged inside the sleeve 111 and spaced from each other in the circumferential direction of the sleeve 111. The magnets include the main magnet facing the portion of the sleeve 111 substantially closest to the drum 100, a scooping magnet for scooping up the developer onto the sleeve 111, a conveying magnet for conveying the developer deposited on the sleeve 111, and another conveying magnet for collecting the developer after development in a developing device.

We analyzed the behavior of the carrier grains C and toner grains T in the consecutive portions I, II and III of the developing zone. For this purpose, we shot the carrier grains C and toner grains T with a stereoscopic microscope SZH10 (trade name) available from OLYMPUS OPTICAL CO., LTD and a high-speed camera FASTCAM-ULtima-$I^2$ (trade name) available from PHOTRON LTD at a speed of 9,000 to 40,500 frames per second. Characteristic behavior observed was that the toner grains T flew away when the brush chains started rising on the sleeve 111. We named this characteristic phenomenon "splashing". Also, we named the toner grains T flown away from the brush chains "free toner grains T". The present invention proposes a new, useful developing method using the splashing of the toner grains T to occur when the brush chains start rising on the sleeve 111.

Figure 2:
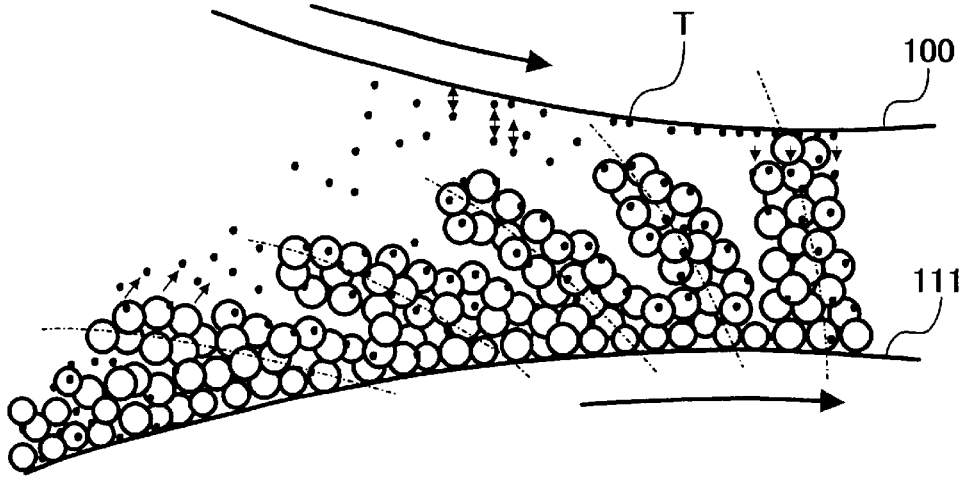
FIG. 2 demonstrates splashing unique to the method of the present invention and occurring when brush chains formed by the carrier grains start rising in the upstream portion of the developing zone.

FIG. 2 shows how the brush chains formed by the carrier grains C start rising on the sleeve 111 in the upstream portion I in accordance with the method of the present invention. The developer forms a magnet brush at positions where the magnets are located without regard to polarity, and form a thin layer between the magnets. As shown in FIG. 2, the carrier grains C confined in the developer layer exert a magnetic force. The magnetic lines of force are small in size between nearby magnets, but are great in size in the circumferential direction because nearby magnets are of opposite polarities. Therefore, the developer containing the carrier grains C form a thin layer between the magnets.

When the thin developer layer arrives at the position where the main magnet is located, some carrier grains C gather and rise in the form of brush chains. Generally, the number of carrier grains C forming each brush chain is determined by the amount of developer moved away from a metering member 114 (see FIG. 10). Further, the number of carrier grains C forming each brush chain is dependent on the magnetic property of the carrier grains C and the magnetic force and shape of the main magnet as well as on the size and slope of magnetic lines of force determined by the position of the main magnet.

Moreover, the angle and size of magnetic lines of force at the position where the brush chains start rising vary because the sleeve 111 is rotated relative to the main magnet. At this instant, delay particular to the magnetic response of the carrier grains C prevents the brush chains from rising all together along the magnetic lines of force. In addition, although each brush chain constituted by a number of carrier grains C rises by being released from the restraint of the mass, the great magnetic field of the main magnet polarizes all the carrier grains C in the same direction and causes them to repulse each other. Consequently, the developer layer suddenly breaks and causes the carrier grains C to rise in the form of brush chains.

As soon as the carrier grains C rise in the form of brush chains, the toner grains T confined in the mass of carrier grains C are released. This, coupled with an intense centrifugal force acting on the toner grains T deposited on the carrier grains C, separates the toner grains T from the carrier grains C and makes such toner grains T free. The free toner grains T can be easily moved by, e.g., an electric field for development because an electrostatic or a physical adhering force does not act between the toner grains T and the carrier grains C.

Figure 3A:
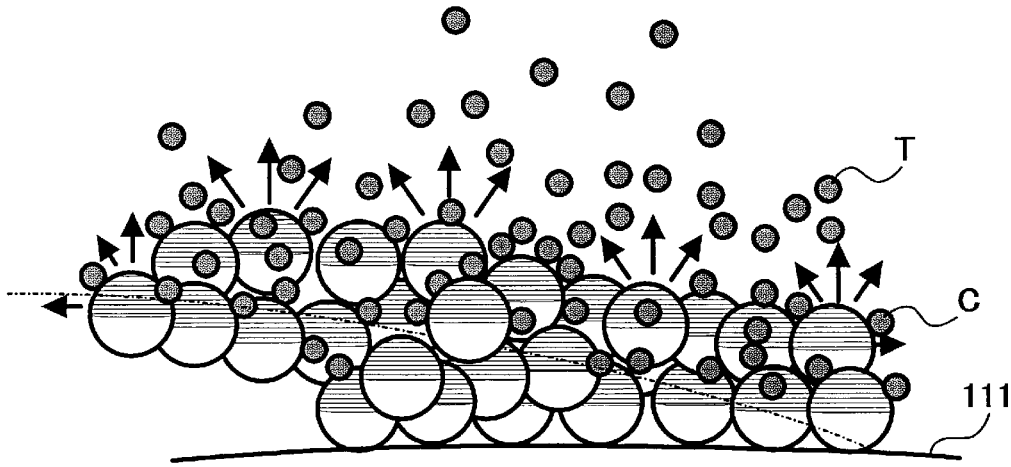
FIGS. 3A and 3B each show a particular condition in which the toner grains part from the brush chains in accordance with the condition of the brush chains.
Figure 3B:
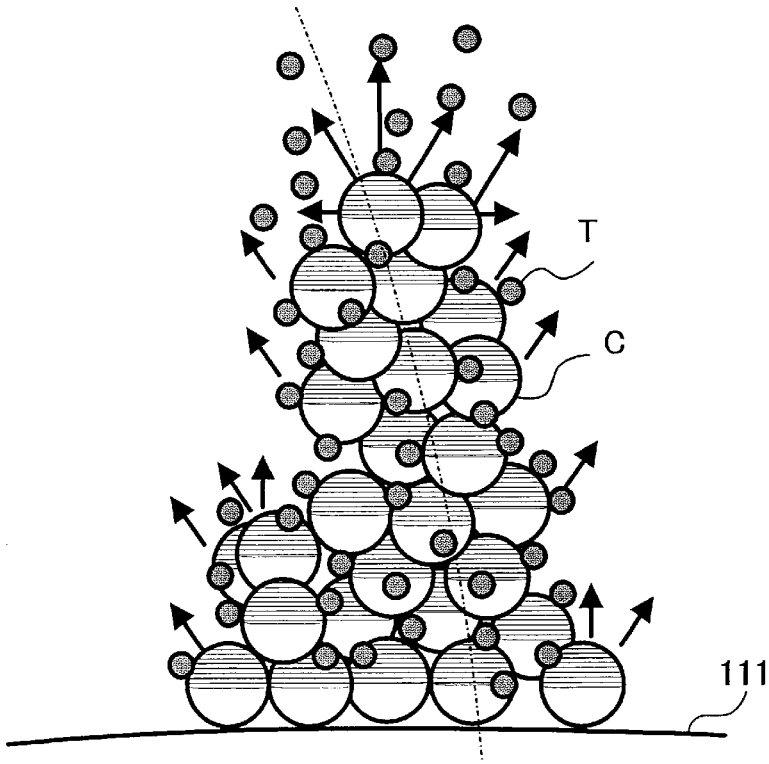

FIG. 3A shows the separation of the toner grains T to occur when a brush chain starts rising. FIG. 3B shows the separation of the toner grains T to occur after the brush chain has fully risen and arrived at a position closest to the drum 100. In FIGS. 3A and 3B, the toner grains on the carrier grains C are allowed to part from the hatched portions of the carrier grains C. Arrows in FIGS. 3A and 3B each indicate the direction of an electric field; the length of each arrow indicates field strength.

Field strength on each carrier grain C is, of course, susceptible to a bias for development, the resistance and grain size of the carrier grain C and so forth. The carrier grains C are substantially charged to substantially the same potential as the sleeve 111 in a moment as soon as they enter the developing zone. Field strength therefore increases as the carrier grains C are positioned closer to the drum 100 or as the tips of the brush chains become sharper. It follows that in the brush shown in FIG. 3B, the toner grains T part from only several carrier grains C forming the tip of the brush chain. However, as shown in FIG. 3A, many carrier grains C face the drum 100 and allow the toner grains T to easily part from them. Further, when the carrier grains C overlap each other, they behave as a single, large mass of conductors in the aspect of potential. Therefore, even the toner grains T on the carrier grains C close to the sleeve 111 are easy to part from such carrier grains C.

The method of the present invention produces the free toner grains T by controlling the force to act on the toner grains T deposited on the carrier grains C. For this purpose, the method of the present invention takes account of the grain size and other powder characteristics of the carrier grains C, the intensity of saturation magnetization and other magnetic characteristics of the carrier grains C, the intensity of saturation magnetization and other magnetic characteristics of the main magnet, and the width, shape and other configuration factors of the main magnet. Further, the brush chains with the free toner grains T increase the amount of toner to deposit on a latent image L (see, e.g., FIGS. 9A through 9C), insuring desirable development. In addition, the free toner grains T that can be driven even by a low electric field are produced in the upstream portion I.

In the intermediate portion II, FIG. 1, the toner grains T deposited on the carrier grains C are splashed onto the drum 100 for thereby developing a latent image. More specifically, the brush chains strongly hit against the drum 100 to thereby splash the toner grains T onto the drum 100.

Figure 4:
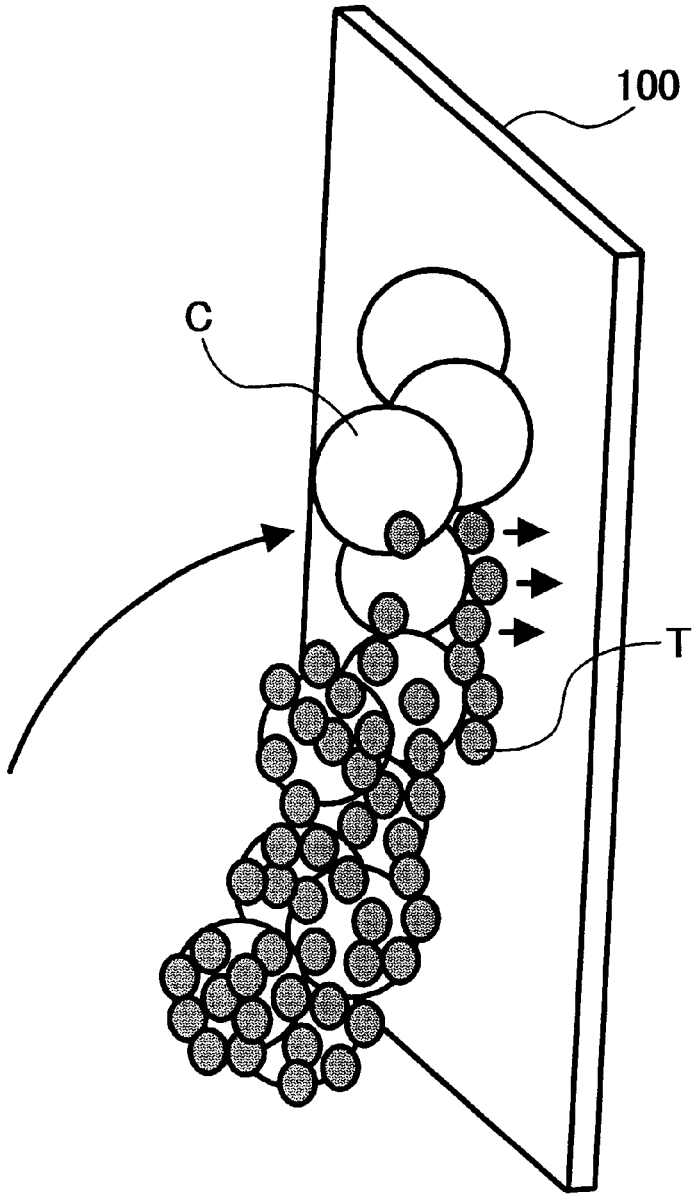
FIG. 4 shows a condition in which the brush chains strongly hit against a photoconductive element in the intermediate portion of the developing zone.

FIG. 4 shows how a brush chain formed by the carrier grains C strongly hit against the drum 100 in the intermediate portion II in accordance with the method of the present invention. The size, particularly height, of the brush chain is determined by the various characteristics of the carrier grains C and those of the main magnet mentioned earlier. The brush chain on the sleeve 111 therefore moves at substantially the same speed as the sleeve except when it slips on the sleeve 111. Therefore, when the height of the brush chain is greater than the distance between the sleeve 111 and the drum 100, the brush chain strongly hits against the drum 100 at a speed at which it rises along the magnetic lines of force of the main magnet and the peripheral speed of the sleeve 111.

Even if the brush chain fully rises before hitting against the drum 100, the brush chain moves in the direction in which the distance between the sleeve 111 and the drum 100 decreases toward the center of the developing zone. Therefore, so long as the height of the brush chain is greater than the smallest distance between the sleeve 111 and the drum 100, the brush chain hits against the drum 100 at a speed equal to a difference between the peripheral speed of the sleeve 111 and that of the drum 100.

When the brush chain strongly hits against the drum 100, the resulting impact causes the toner grains T to part from the carrier, grains C. The toner grains T are then transferred to the drum 100 because of the electric field of the latent image L and the electric field between the sleeve 111 and the drum 100.

In the downstream portion III, FIG. 1, the brush chains rub against the drum 100 to release the toner grains T. In the downstream portion III, the brush chains are conveyed on the sleeve 111 while rubbing against the drum 100.

Figure 5:
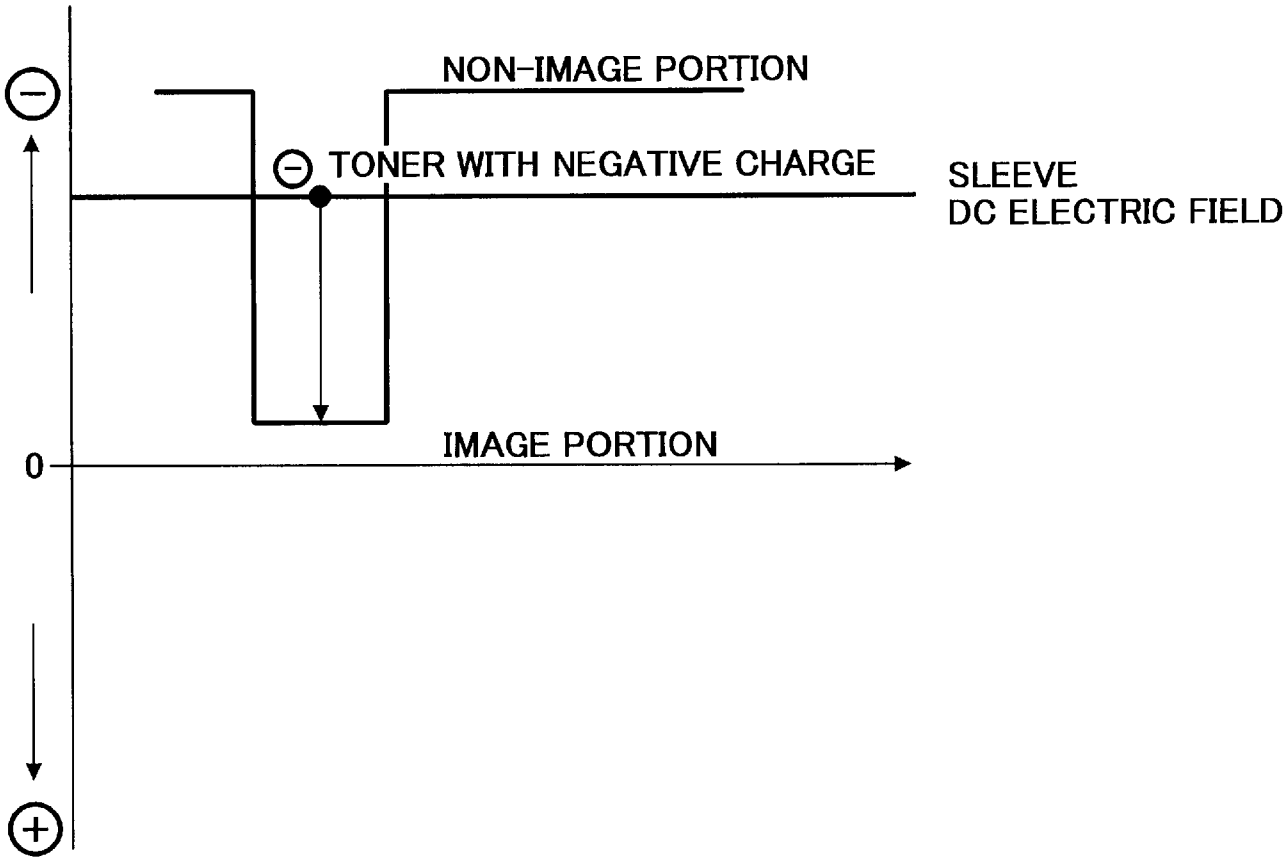
FIG. 5 shows the application of a DC electric field effected in a reversal type developing system.
Figure 6A:
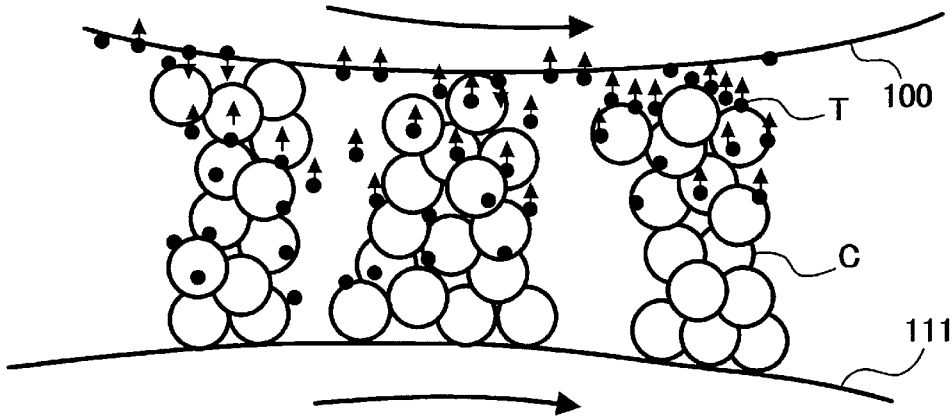
FIGS. 6A and 6B show the toner grains being deposited on the photoconductive element.
Figure 6B:
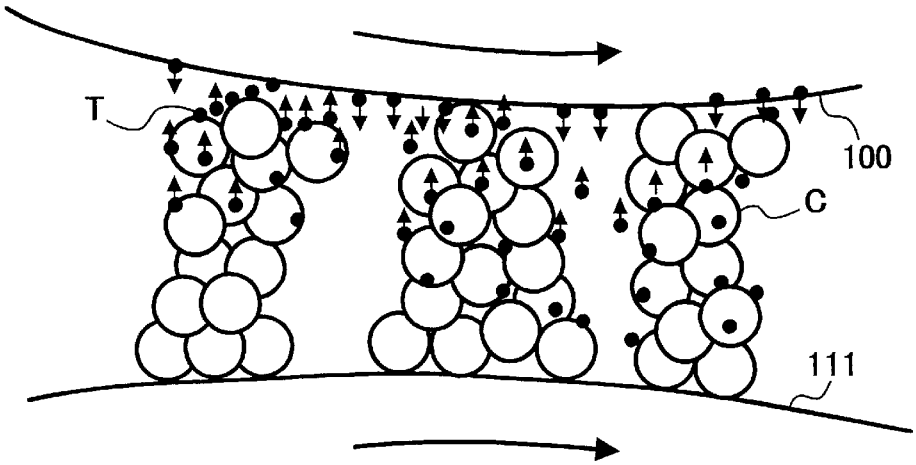

FIG. 5 shows a DC electric field applied in a reversal type developing system. FIG. 6A demonstrates how the toner grains T move on the carrier grains C while FIG. 6B demonstrates how the toner grains T move in the non-image portion of the drum 100. As shown, a DC electric field for development is usually formed between the sleeve 111 and the drum 100. Assume that the drum 100 is implemented with an organic photoconductor using an organic pigment as a carrier generating material. Then, it is a common practice to charge the drum 100 to negative polarity. Generally, the polarity of charge of the drum 100 is not an important question. When a laser beam writes a text latent image on the drum 100, holes generated by the carrier generating material neutralize the charge of the text latent image and thereby lower the potential, as shown in FIG. 5.

An electric field of negative-polarity is applied to the sleeve 111 so as to transfer the toner grains T of negative polarity to the latent image formed on the drum 100. In the downstream portion III, the electric field between the drum 100 and the sleeve 111 and the electric field between the drum 100 and the carrier grains C cause the toner grains T to move toward the latent image.

Further, the carrier grains C reached the downstream portion III has lost many toner grains T in the preceding portions I and II, so that the amount of charge deposited thereon is excessive. Such carrier grains C move while rubbing against the drum 100 and therefore catch up with the toner grains T existing on the drum 100. The carrier grains C then strongly hit against the toner grains T. The resulting impact and an electrostatic Coulomb's force derived from the opposite charges cause the toner grains T to deposit on the carrier grains C away from the drum 100. More specifically, the toner grains T are, in many cases, released from the non-image portion of the drum 100 because the amount of charge deposited on the non-image portion by a charger and therefore the electric field tending to retain the toner grains T on the drum 100 is small. This successfully frees the non-image portion from contamination and thereby insures a high quality image.

In accordance with the present invention, the amount of free toner grains T produced by splashing should be 50% to 200%, preferably 80% to 150%, of the total amount of toner grains deposited on a latent image in terms of weight.

In the upstream portion I of the developing zone, when the carrier grains C form brush chains and start rising, the toner grains T are released from the carrier grains C. The electric field for development allows the resulting free toner grains T to move toward the drum 100. In the intermediate portion II, the brush chains further contact the drum 100 and splash the toner grains T onto the drum 100, thereby developing a latent image. At the same time, the toner grains T previously deposited on the drum 100 are collected by the carrier grains C. More specifically, the toner grains T deposited on the non-image portion or the low-potential image portion of the drum 100 in the portions I and II are returned to the carrier grains C, so that high image quality is achieved. In the downstream portion III, the carrier grains C on the tips of the brush chains rub against or adjoin the drum 100 and develop the latent image with the toner grains T in the presence of the electric field.

As for a text image portion, in the downstream portion III, the toner grains T on the brush chains lost many toner grains T in the portions I and II move from the roots to the tips of the brush chains (toner drift). As for a portion other than the text image portion, the toner grains T deposited on the drum 100 in the portion I or II move toward the roots of the brush chains (toner drift). However, as for a text image portion, a minimum amount of toner drift toward the drum 100 suffices because the toner grains T already exist on the drum 100. On the other hand, the toner grains T in the portion other than the text image portion smear the sleeve 111 little because they must move a long distance to the sleeve surface. More specifically, image quality is not affected even if the brush chains carry only a small amount of toner grains T during development. This more positively obviates residual images and other defective images ascribable to the contamination of the sleeve 111.

As stated above, the method of the present invention can use the entire surface of the sleeve 111 facing the drum 100 as a developing zone. More specifically, paying attention to three consecutive portions of the developing zone, the developing method controls the movement of the carrier grains C to cause much toner to deposit on the drum 100 for thereby insuring high quality images.

In accordance with the present invention, the center of the magnetic pole inside the sleeve 111 should preferably be tilted toward the downstream size in the direction of developer conveyance. This broadens the upstream portion I of the developing zone and thereby increases the amount of free toner grains T.

Figure 7:
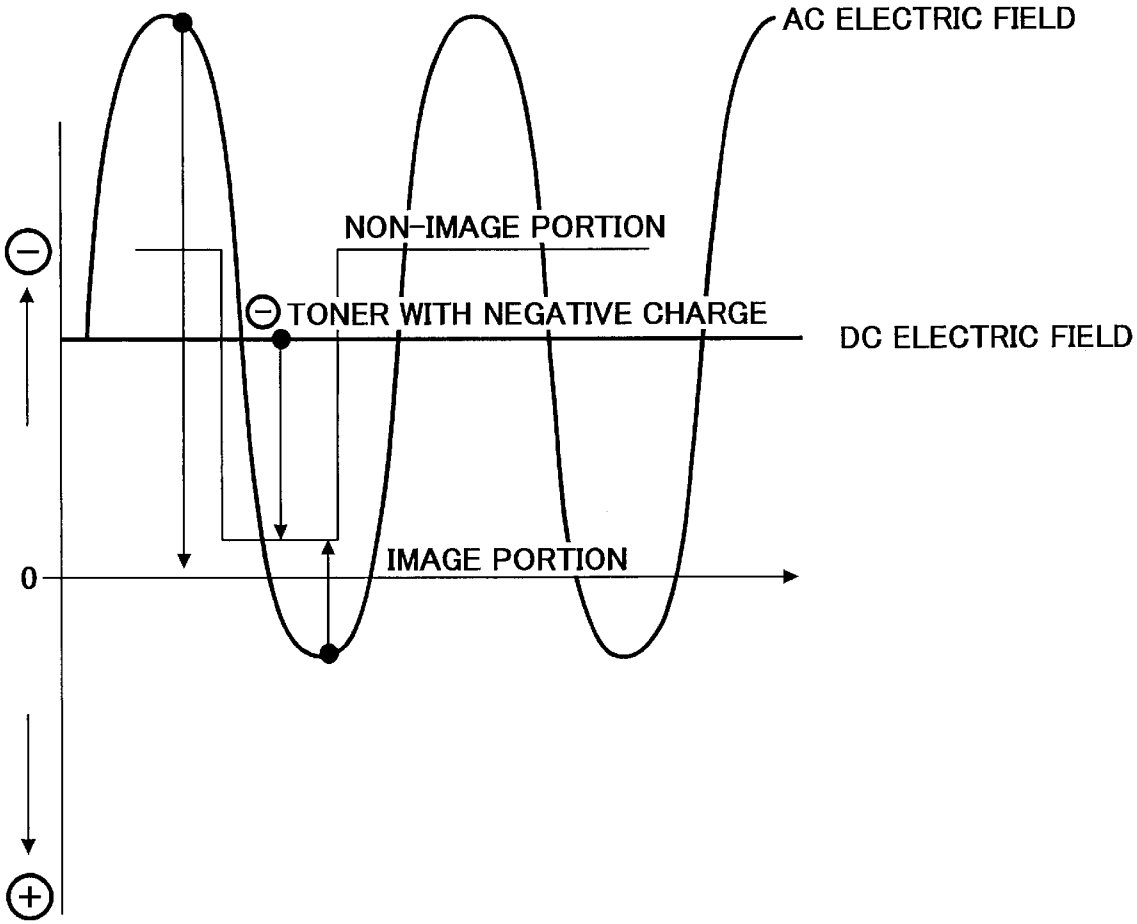
FIG. 7 shows the application of an AC-biased DC voltage effected in the reversal developing system.
Figure 8A:
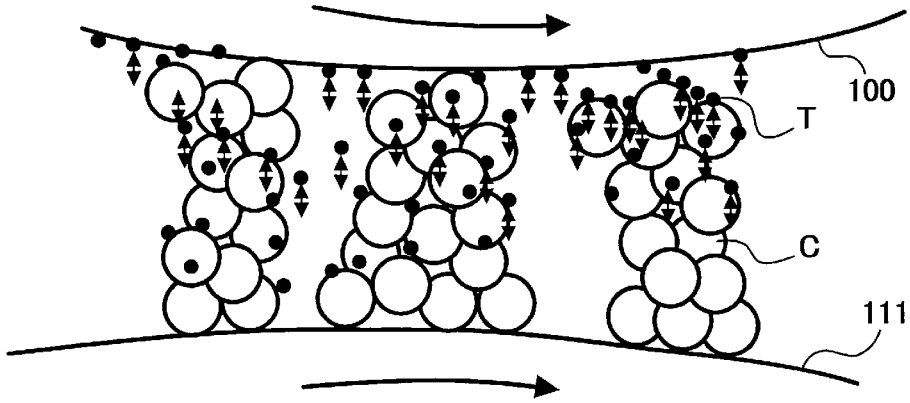
FIGS. 8A and 8B show how the toner grains are transferred to the photoconductive element in the downstream zone of the developing zone.
Figure 8B:
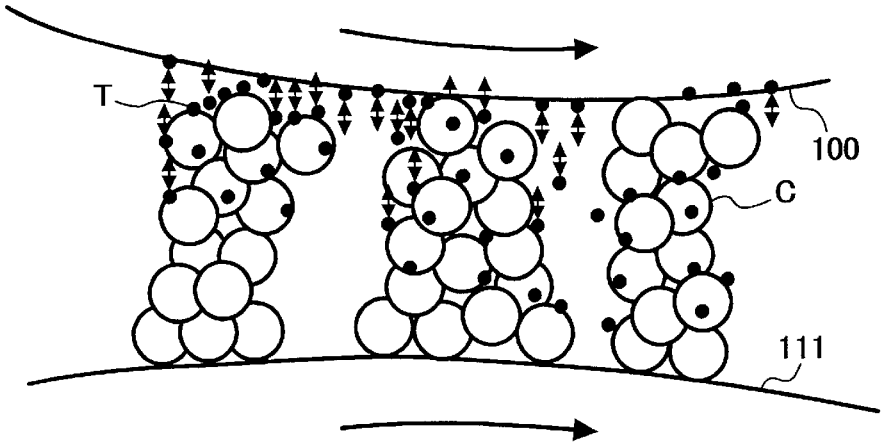

FIG. 7 shows an alternating electric field that may be formed by an AC-biased DC voltage in place of the DC electric field. FIG. 8A show how the toner grains T move on the carrier grains C in the downstream portion III in an image portion in the presence of the alternating electric field. FIG. 8B shows how the toner grains T move on the carrier grains C in an image portion.

Usually, an alternating electric field for development is formed between the sleeve 111 and the drum 100. The alternating electric field, like the previously stated DC electric field, transfers the toner grains T from the brush chains to the drum 100. In this case, too, the electric field is further enhanced on the drum 100 and the brush chains because the carrier grains C on the sleeve 111 are a dielectric. As a result, the toner grains on the carrier grains C deposit on a latent image formed on the drum 100. Further, the alternating electric field causes the toner grains T on the drum 100 to oscillate and faithfully deposit on the latent image, implementing high image quality.

In accordance with the present invention, the range in which the toner grains T part from the brush chains started rising in the developing zone is limited to a range in which the resulting free toner grains T can move toward a latent image.

The free toner grains or splashed toner grains T appear in the upstream portion I in the form of cloud or smoke. Most of the free toner grains T are easy to move toward a latent image formed on the drum 100 because of the electric field for development. This will be described hereinafter with reference to FIGS. 9A through 9C.

Figure 9A:
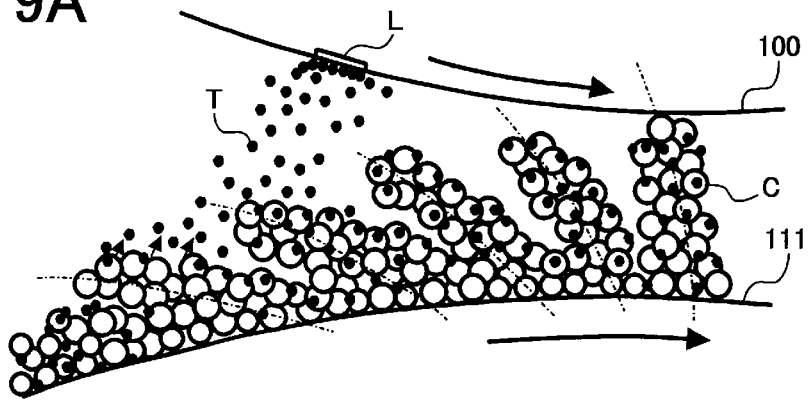
FIGS. 9A through 9C show the transfer of the toner grains occurring in the downstream portion of the developing zone.

First, as shown in FIG. 9A, in the upstream portion I, the brush chains forced against the surface of the sleeve 111 start rising. In this portion I, the impact and centrifugal force stated earlier produce a space (splashing range hereinafter) in which the toner grains T move. As a result, the toner grains T between the brush chains are released and become free toner grains, forming cloud or smoke.

Figure 9B:
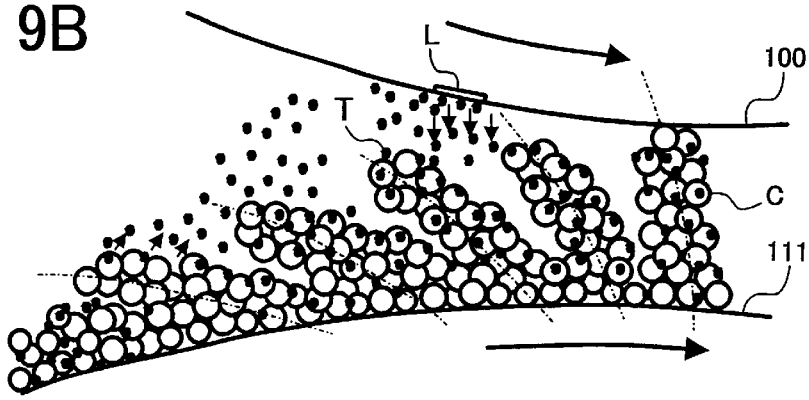

As shown in FIG. 9B, the free toner grains T deposit on the latent image L formed on the drum 100 due to attraction exerted by the electric field. In a non-image portion, the electric field is directed toward the sleeve 111 and causes the free toner grains T to return to the carrier grains C or the sleeve 111. This enhances the efficient use of toner grains T and protects the inside of the apparatus from contamination. Alternating current applying means, not shown, applies an alternating current at the position where the drum 100 and sleeve 111 face each other. Further, the brush chains contact the drum 100 in the intermediate portion II and downstream portion III, so that an electrode effect acts between the carrier grains C forming the tips of the brush chains and the drum 100. The electrode effect further uniforms a toner layer forming an image and efficiently scavenges the toner grains T deposited on a non-image portion. This is also true when the alternating electric field is replaced with the DC electric field. In addition, the duration of contact of the brush chains with the drum 100 is shorter in the present invention than in conventional contact development using the two-ingredient type developer. The present invention therefore obviates various defects dependent on direction, e.g., the thickening of horizontal lines and the omission of the trailing edge of an image.

As shown in FIG. 9B, the alternating electric field and nearby brush chains cause the toner grains T to move back and forth (oscillate) between the carrier grains C forming the tips of the brush chains and the drum 100. Such reciprocal movement promotes the formation of a uniform toner layer in an image portion to thereby enhance dot reproducibility while scavenging the toner grains T deposited on a non-image portion.

Figure 9C:
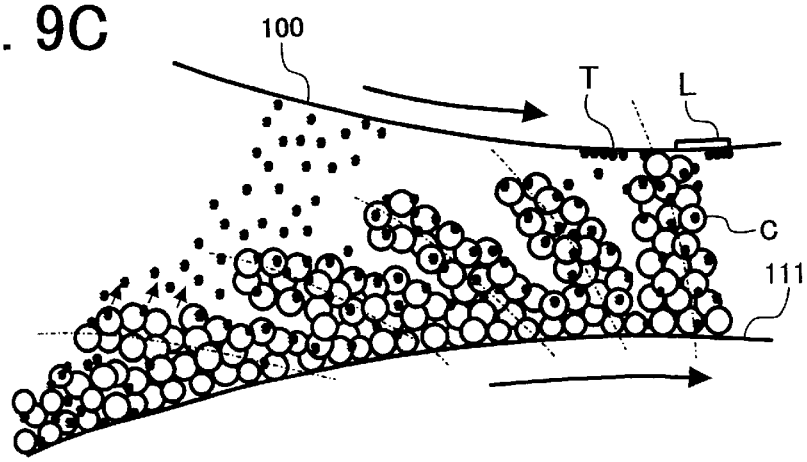

As shown in FIG. 9C, the alternating electric field and contact development cause the toner grains T to move back and forth (oscillate) between the carrier grains C on the tips of the brush chains and the drum 100. Such reciprocal movement also implements the advantages stated above.

In accordance with the present invention, the magnetic field applying means, which is associated with a developer carrier, controls the range in which the free toner grains T fly away from the brush chains when the brush chains start rising. Brush chains rise along the magnetic lines of force of the magnet or magnetic field forming means disposed in the sleeve 111. Therefore, by controlling the rise of the brush chains, it is possible to control the above range.

The amount of toner to deposit on a latent image is dependent on required image quality and can be controlled in terms of process conditions and the conditions of the developer. Therefore, the amount of free toner grains T is also determined under the above conditions. It follows that the range where the free toner grains T appear may be located at either one of the upstream side and downstream side in the direction of developer conveyance.

Figure 10:
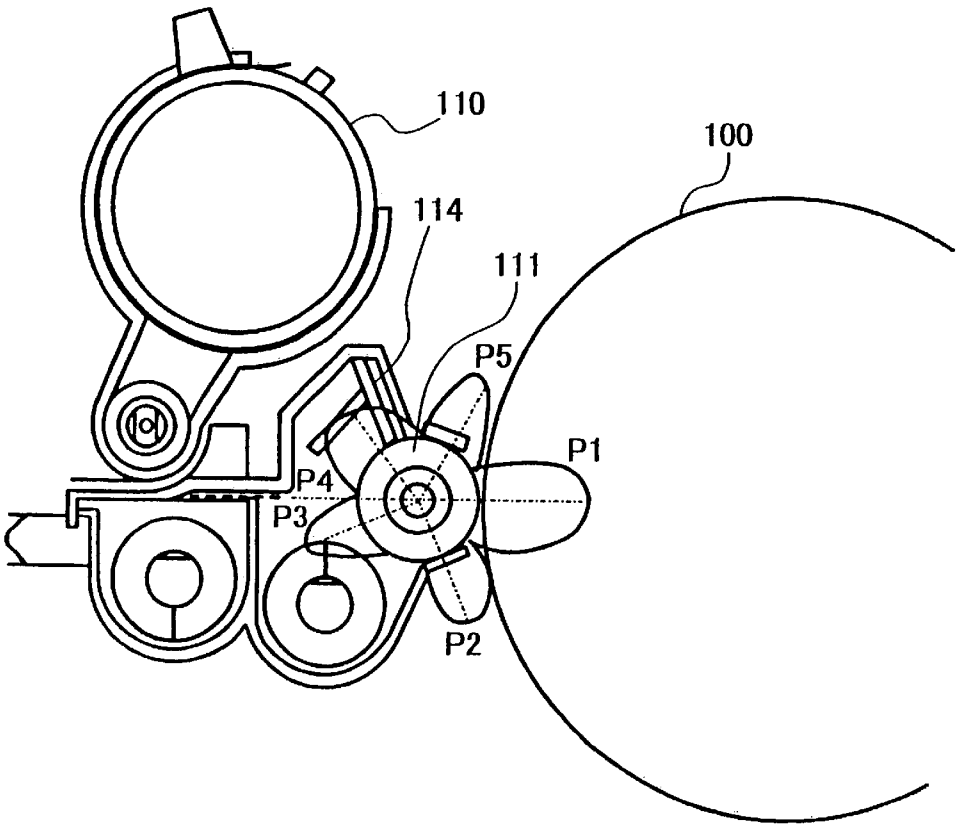
FIG. 10 shows a specific configuration of a developing device to which the method of the present invention is applied.

FIG. 10 shows a specific arrangement including a main magnetic pole P1 for development. As shown, the main pole P1 has a peak magnetic force located at a position M1 (see FIG. 11) in the direction normal to the sleeve 111. A magnet roller has magnets arranged such that the above position M1 is positioned downstream of a position M0 (see FIG. 11) where the sleeve 111 is closest to the drum 100 in the direction of movement of the drum 100 (counterclockwise). Stated another way, the peak position M1 is shifted from the position M0 by 0 degree to 30 degrees. This locates as great part of the range where the free toner grains T appear at the initial stage as possible in the range where the grains T can move toward the latent image L. Preferably, the position where the free toner grains T appear in the upstream portion I faces the position M0. The angle between the magnet P1 and a magnet P5 is 60 degrees, so that the magnetic force is zero at an angle of 30 degrees between the magnets P1 and P5. Stated another way, the brush chains rise at or around the position M0 or the skirt portion of the magnetic lines of force of the main pole P1 at the upstream side.

In accordance with the present invention, the ratio of the linear velocity Vs of the sleeve 111 to the linear velocity Vp of the drum 100, i.e., Vs/Vp lies in the range of $0.9<Vs/Vp<4$. The sleeve 111 and drum 100 move in the same direction at the position where they face each other. Even if the linear velocity of the sleeve 111 is lower than the linear velocity Vp of the drum 100, i.e., even if the ratio Vs/Vp is smaller than 1, much toner can deposit on a latent image because a sufficient amount of free toner grains T is available. A ratio of 0.9 or above successfully increases the amount of toner T to deposit on a latent image and thereby insures high image density. The above ratio may be further reduced, depending on the amount of free toner grains T available.

An increase in ratio Vs/Vp increases the impact ascribable to the contact of the brush chains with the drum 100 in the intermediate portion II, thereby increasing the amount of toner grains T to be splashed. This, however, increases the amount of toner grains T to part from the drum 100 due to the impact as well. Further, in the downstream portion III, the number of times of contact of the brush chains with the drum 100 increases, increasing the amount of toner grains to part from the drum 100. Particularly, ratios Vs/Vp of 4 or above cause the trailing edge of an image to be lost or blur horizontal lines. The ratio Vs/Vp should therefore be less than 4.

Figure 11:
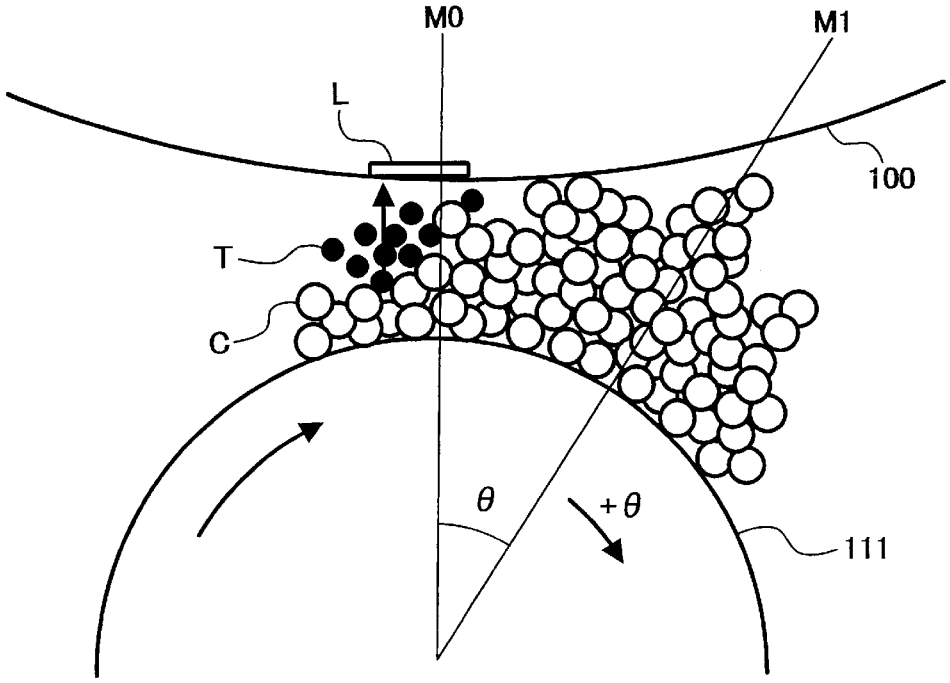
FIG. 11 shows the position of a main magnet accommodated in a sleeve.

FIG. 11 shows a specific configuration of a developing device to which the present invention is applied. A charger, laser optics for exposure, the developing device, an image transferring device, a drum cleaner and a discharger are sequentially arranged around the drum 100 in this order, although not shown specifically. The charger uniformly charges the surface of the drum 100. The laser optics scans the charged surface of the drum 100 with a laser beam for thereby forming a latent image L on the drum 100. The developing device develops the latent image L with the charged toner T. The image transferring device transfers the resulting toner image from the drum 100 to a sheet or recording medium. The cleaning device removes the toner T left on the drum 100 after the image transfer. The discharger discharges potential left on the drum 100. The developing device 110 is positioned at the left-hand side of the drum 100. The charger is implemented as a charge roller by way of example. The sheet is fed from a sheet tray, not shown, to the image transferring device, which may include a belt.

A peeler peels off the sheet electrostatically adhered to the drum 100 from the drum 100. A fixing device, not shown, fixes the toner image on the sheet.

The sleeve 111 and drum 100 adjoin each other and form the developing zone therebetween. The sleeve 111 is a hollow cylindrical body formed of aluminum, brass, stainless steel, conductive resin or similar nonmagnetic material. A driveline, not shown, causes the sleeve 111 to rotate clockwise, as viewed in FIG. 11.

In the specific arrangement shown in FIG. 11, the drum 100 has a diameter of 90 mm and rotates at a linear velocity of 156 mm/sec. The sleeve 111 has a diameter of 18 mm and rotates at a linear velocity of 214 mm/sec. The ratio Vs/Vp is therefore 1.4.

A gap for development between the drum 100 and the sleeve 111 is 0.6 mm. If the carrier grain size is 50 $\mu$m, then the above gap should preferably be 0.65 mm or less, i.e., thirteen times the carrier grain size or less. An excessively narrow gap causes the brush chains to contact the drum 100 over a broad range, aggravating the dependence on direction. An excessively broad gap prevents sufficient field strength to be obtained and renders solitary dots and solid portions irregular. While the voltage may be raised to maintain field strength, this kind of scheme is apt to cause a solid image to be locally lost in the form of white spots due to discharge.

A doctor blade or metering member, not shown, is positioned upstream of the developing zone in the direction of developer conveyance (clockwise in FIG. 11). The doctor blade regulates the thickness of the developer deposited on the sleeve 111 in the form of a layer. A doctor gap between the doctor blade and the sleeve 111 is selected to be 0.65 mm. While the doctor blade has customarily been implemented as a plate of nonmagnetic material, the doctor blade included in this specific configuration is implemented as a plate of magnetic material adhered to the conventional nonmagnetic plate. The magnetic material readily provides the brush chains with substantially the same height, as will be described later specifically.

An agitator implemented as a screw, not shown, is located at the opposite side to the drum 100 with respect to the sleeve 111. The agitator scoops up the developer stored in a casing onto the sleeve 111 while agitating it. More specifically, drive means, not shown, causes the agitator to rotate at a speed of 152 rpm (revolutions per minute) and agitate the toner grains T and carrier grains C. As a result, the toner grains T are charged by friction.

A stationary magnet roller is disposed in the sleeve 111 and forms a magnetic field that causes the developer to rise on the sleeve 111 in the form of a magnet brush, as shown in FIG. 2. The carrier grains C form brush chains along the magnetic lines of force issuing from the magnet roller. The toner grains T deposit on the brush chains, forming a magnet brush. The magnet brush is conveyed in the direction in which the sleeve 111 rotates. More specifically, the magnet roller has a main magnet for causing the developer to rise in the developing zone, a scooping magnet P3 for scooping up the developer onto the sleeve 111, conveying magnets P4 and P5 for conveying the developer deposited on the sleeve 111 to the developing zone, and a magnet P2 for conveying the developer in the zone following the developing zone. The magnets P1 through PS each are oriented in the radial direction of the sleeve 111.

The main magnet P1, in particular, has a small cross-sectional area and may be formed of a samarium alloy, particularly a samarium-cobalt alloy. An iron-neodium-boron alloy magnet, which is a typical rare earth metal magnet, has the maximum energy product of 358 kJ/m$^3$ while an iron-neodium-boron alloy bond magnet has the maximum energy product of around 80 kJ/m$^3$. By contrast, a conventional ferrite magnet and a ferrite bond magnet have the maximum energy products of 36 kJ/m3 and 20 kJ/m$^3$, respectively. The above alloy magnet can therefore exert a sufficient magnetic force on the surface of the sleeve 111 even if it is far smaller in size than conventional magnets. If the sleeve diameter can be increased, then the ferrite or ferrite bond magnet may be increased in size or provided with a narrow tip facing the sleeve 111 for thereby reducing the center half-angle.

The magnetic carrier grains C may be formed of, e.g., iron, nickel, cobalt or similar metal or an alloy of such metal with another metal, magnetite, γ-hematite, chromium dioxide, copper-lead ferrite, manganese-lead ferrite or similar oxide, or manganese-copper-aluminum or similar alloy or similar ferromagnetic material. If desired, the grains of such a ferromagnetic material may be coated with fluorocarbon resin or similar resin. Further, a charge control agent, a conductive substance and other additives may be added to the resin that coats the magnetic grains. Alternatively, such magnetic grains may be dispersed in styrene-acrylic resin, polyester resin or similar resin.

The toner grains T are formed of at least thermoplastic resin and carbon black, copper phthalocyanine quinacridone or bis-azo pigment. The resin should preferably be styrene-acrylic resin or polyester resin. If desired, the resin may contain polypropylene or similar wax for promoting fixation and alloy-containing dye for controlling the amount of charge to deposit on the toner grains T. An oxide, a nitride or a carbonate of surface-treated silica, aluminum, titanium oxide or similar oxide may be coated on the toner grains T. In addition, a fatty acid metal salt or fine resin grains may be provided on the outer surfaces of the toner grains T.

The magnets P3, P5 and P2 are magnetized to N polarity while the main magnet P1 and magnet P4 are magnetized to S polarity. The magnet P2 positioned downstream of the main magnet P1 help the main magnet P1 exert a main magnetic force. The magnet P2 causes the carrier grains C to deposit on the drum 100 if too small in size.

To cause the magnet brush to splash the toner grains T when it starts rising, the sleeve 111 should preferably have a diameter between 18 mm and 30 mm. For the same purpose, the main magnet P1 should preferably have a width between 6 mm and 8 mm in terms of the half width of the peak flux density. Further, the flux density of the main magnet P1 should preferably be between 100 mT and 130 mT.

The toner content of the developer should range from 4 wt % to 10 wt % while the amount of charge to deposit on the toner grains T (q/m) should range from −5 μC/g to −60 μC/g, preferably from −10 μC/g to −35 μC/g. The carrier grains C should preferably be implemented as spherical ferrite grains coated with resin. The saturation magnetization should preferably be 45 emu/g to 85 emu/g. Saturation magnetization below 45 emu/g is too low to surely convey the carrier grains C and increases the amount of carrier deposition on the drum 100. Saturation magnetization above 85 emu/g makes the magnet brush excessively strong and undesirably enhances the scavenging effect, producing scavenging marks on a halftone image. The volume mean grain size of the carrier grains C should be 20 μm to 100 μm, preferably 30 μm to 60 μm. At least 15% of the carrier grains C should preferably be grains having sizes of 20 μm to 100 μm. This is because the amount of carrier grains C contained in each brush chain is determined to a certain degree, and therefore an increase in grain size translates into a decrease in the amount of toner grains T. The carrier grains C should preferably have a specific volume resistivity of 6 Log Ω·cm to 12 Log Ω·cm, so that the potential of the carrier grains C can become equal to the potential of the sleeve 111 in a relatively short period of time. The toner grains T should preferably have a volume mean grain size of 4 μm to 10 μm; the content of fine grains of 4 μm or below should preferably be 20% or below in terms of number. While the toner grains T may contain silica, alumina, titania or similar additive, it should preferably have a bulk density of 0.25 g/cm$^3$ or above; the greater the bulk density, the easier the separation of the toner grains T from the carrier grains C.

The configuration characteristics and electric characteristics of the developer carrier and those of the image carrier are so selected as to form an electric field that causes the toner grains T parted from the carrier grains C to move toward the image carrier. For this purpose, the free toner grains T should preferably deposit on the image carrier as rapidly as possible. This can be done with an electric field having a rectangular waveform.

Figure 12:
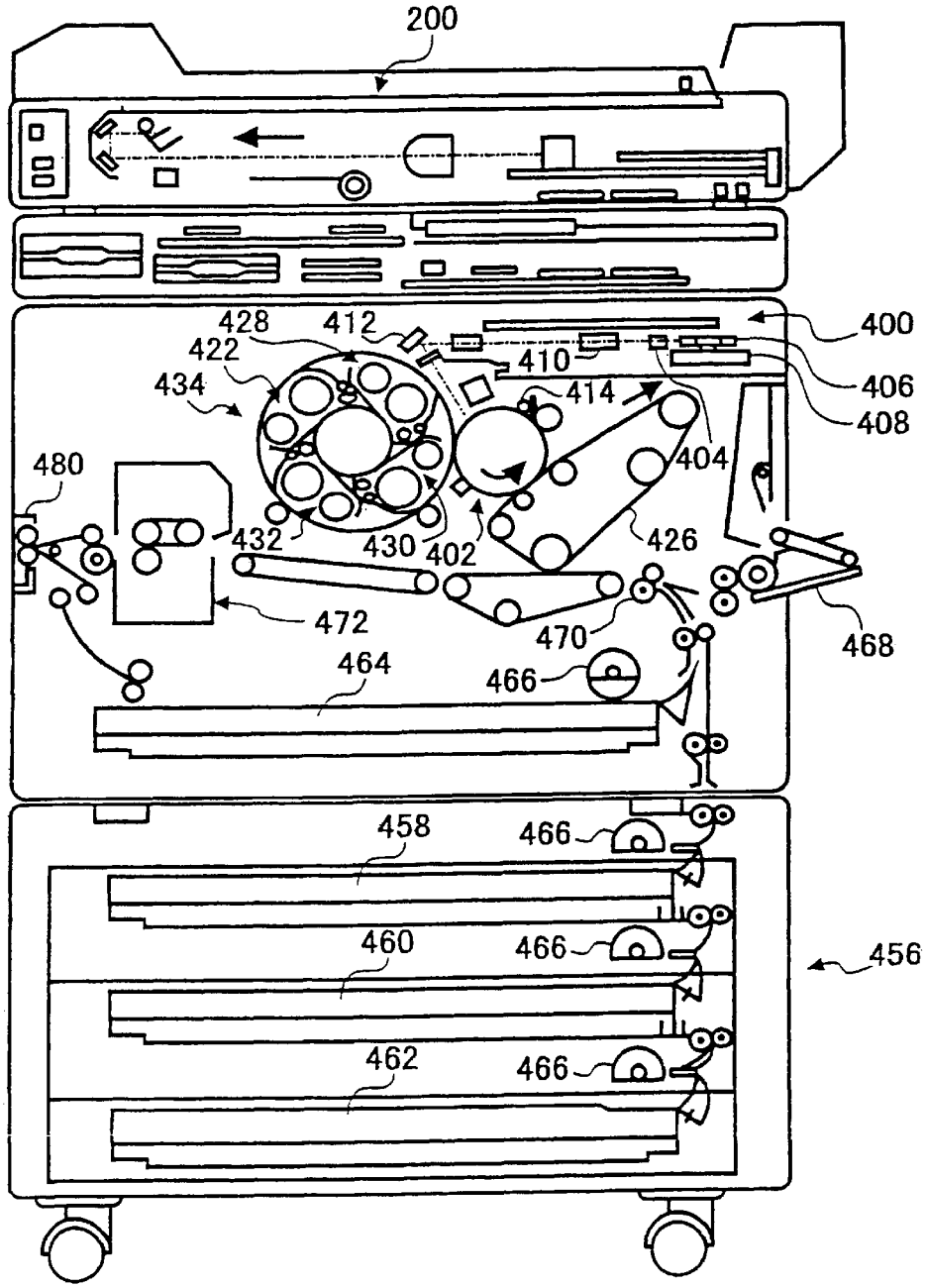
FIG. 12 shows a specific configuration of an image forming apparatus in accordance with the present invention.

Referring to FIG. 12, an image forming apparatus including the developing device described above is shown and implemented as a color copier by way of example. As shown, the color copier includes an optical unit or exposing means 400. The optical unit 400 scans the charged surface of a drum or image carrier 402 with a laser beam in accordance with image data output from a color scanner 200, thereby forming a latent image L on the drum 402. More specifically, the optical unit 400 includes a laser diode 404, a polygonal mirror 406, a motor 408 for driving the mirror 406, an f/θ lens 410, and a mirror 412. The drum 402 is rotated counterclockwise, as indicated by an arrow in FIG. 12. Arranged around the drum 402 are a drum cleaner 414, a discharge lamp, a potential sensor, a developing device implemented as a revolver 434, and an intermediate image transfer belt (simply belt hereinafter) 426. One of developing sections arranged in the revolver 434 is located at a developing position where it face the drum 402.

The revolver 434 includes a B (black) developing section 430, a Y (yellow) developing section 432, a C (cyan) developing section 422, and an M (magenta) developing section 428. A driveline, not shown, causes the revolver 434 to rotate. The B, Y, C and M developing sections 432 through 428 have the previously described configuration each and operate with the carrier grains C having the previously described conditions and specifications. In a stand-by state, the B developing section 430 is located at the developing position, as shown in FIG. 12. On the start of a copying operation, the color scanner 200 starts reading black image at a preselected timing and feeds image data to the optical unit 400. The optical unit 400 starts forming a latent image (B latent image hereinafter) L on the drum 402 in accordance with the image data.

Before the leading edge of the B latent image L arrives at the B developing section 430, the sleeve 111 of the developing section 430 starts rotating in order to develop the B latent image L with black toner T. As soon as the trailing edge of the B latent image moves away from the developing position, the revolver 434 is rotated to bring the next developing section to the developing position. This rotation completes at least before the leading edge of the next latent image L arrives at the developing position. On the start of an image forming cycle, the drum 402 and belt 426 are rotated counterclockwise and clockwise, respectively. A B toner image, a Y toner image, a C toner image and an M toner image are sequentially transferred from the drum 402 to the belt 426 one above the other, completing a full-color toner image on the belt 426.

The belt 426 is passed over a drive roller and a driven as well as over the other rollers. A motor, not shown, drives the belt 426. A corona discharger, not shown, transfers the full-color toner image from the belt 426 to a sheet.

A sheet bank 456 includes sheet cassettes 458, 460 and 462 each being loaded with a stack of sheets different in size from sheets stacked on a cassette 464, which is positioned in the copier body. A pickup roller 466 pays out a sheet from selected one of the sheet cassettes 458 through 464 toward a registration roller pair 470. A manual feed tray 468 is assigned to OHP (OverHead Projector) sheets, relatively thick sheets and other special sheets. The registration roller pair 470 stops the sheet fed from any one of the cassettes 458 through 464 and manual feed tray 468. The registration roller pair 470 starts conveying the sheet such that the leading edge of the sheet meets the leading edge of the full-color toner image being conveyed toward the corona discharger by the belt 426.

The corona discharger, which is connected to positive potential, charges the sheet to positive polarity and thereby transfers the full-color toner image from the belt 426 to the sheet. A fixing device 472 fixes the toner image on the sheet with heat and pressure. The sheet with the fixed toner image, i.e., a full-color copy is driven out of the copier body by an outlet roller pair 480 and stacked on a copy tray not shown.

The carrier grains C applied to the color copier were implemented as spherical copper-zinc ferrite grains coated with silicone resin. The carrier grains C had a volume mean grain size of 58 μm, magnetization strength of 65 emu/g, and a specific volume resistivity of 8.5 Log Ω·cm. The toner grains T were implemented as polyol resin grains containing a pigment and a charge control agent, coated with 0.7 wt % of hydrophobic silica and having a static bulk density of 0.33 g/cm$^3$. The black toner contained carbon black as a pigment while the yellow toner contained a bis-azo pigment. Further, the magenta toner and cyan toner contained a quinacridone pigment and a copper-phthalocyanine pigment, respectively. A developer containing any one of such toners had the initial toner content of 5 wt %; the initial amount of charge was −20 μC/g to −35 μC/g on each toner.

While the revolver 434 is shown as being positioned at one side of the drum 402, the former may be positioned below the latter in order to prevent the toner from flying about.

First Embodiment

A first embodiment of the present invention will be described hereinafter. First, the contribution of the free toner grains T to development was estimated. While the above developer was used unless otherwise stated, estimation was conducted only with the black toner.

EXAMPLE 1 AND COMPARATIVE EXAMPLE 1

By using the stereoscopic microscope and high-speed camera mentioned earlier, we shot the behavior of the toner grains T in the portion I of the developing zone at a speed of 9,000 frames to 40,500 frames per second. FIG. 13 lists developers and process conditions used in Example 1 and Comparative Example 1.

In Example 1, video showed that the toner grains T parted the carrier grains C. However, in Comparative Example, the separation of the toner grains T from the carrier grains C was not observed at all. This indicates that the free toner grains T are achievable even by adjusting the developer.

EXAMPLES 2 AND 3 AND COMPARATIVE EXAMPLES 2 AND 3

Figure 14:
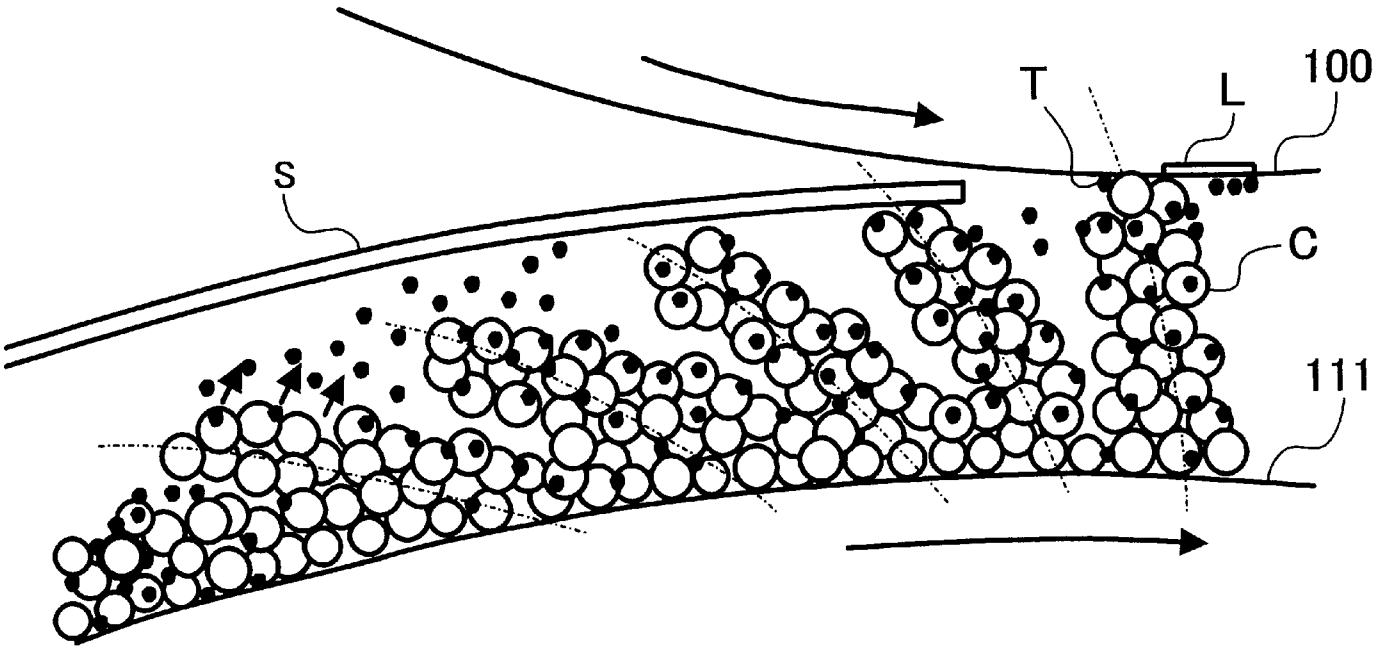
FIG. 14 demonstrates how the toner grains behave when a polyester film sheet is positioned in the developing zone.

FIG. 14 shows a polyester film sheet S that we inserted into the developing section in order to examine the influence of the free toner grains T on an image. The polyester film sheet S was 150 μm thick and positioned to enclose the splashing range of the developing zone where the free toner grains T appeared. It was found that although the amount of toner grains T deposited on the latent image L passed through the developing zone changed little, image density was lowered due to irregular density.

We further examined the amount of free toner grains T and the amount of toner deposition after development by varying the process conditions. To determine the amount α(mg) of free toner grains T and the amount β of toner grains T deposited on the drum 100, toner grains T deposited on the drum 100 were transferred to an adhesive tape and had a weight thereof converted to a unit area (cm$^2$).

To estimate a relation between the amount of free toner grains T and an image with the above-described image forming apparatus, we used carrier grains C having a mean grain size of 50 μm and toner grains T having a mean grain size of 7 μm and produced by pulverization. The main pole had an angle θ of 0° and was located at the position where the drum 100 and sleeve 111 were closest to each other.

FIG. 15 lists developers and process conditions used for experiments. FIG. 16 shows the results of estimation. As shown, when the polyester film sheet S enclosed the splashing range in Comparative Example 2, image density was less uniform than when the sheet S was absent. At the same time, a residual image appeared in a halftone portion while the peripheral portion of a text image was conspicuously lost. Presumably, the omission of the peripheral portion of a text image occurs because the electric field at the edges of an image is strong and makes the toner supply from the brush chains short. By contrast, in Example 2, splashing caused 0.7 mg/cm$^2$ of free toner grains T to deposit on the drum 100. Presumably, such an amount of free toner grains T weakened the edge electric field and thereby prevented the peripheral portion of a text image from being lost. An image portion was developed by an amount equal to the amount of free toner grains T. The amount of free toner grains T was 100% of the total amount of development of an image portion.

Comparative Example 3 differs from Example 2 in that toner density was lowered, and that the polyester film sheet S covered part of the splashing range in order to reduce the amount of free toner grains to 0.3 mg/cm$^2$. The developing potential was increased to make up for the decrement of the toner density, thereby setting up the same amount of development as in Example 2. However, in Comparative Example 3, a residual image in a halftone portion was too conspicuous to render the halftone portion usable although image density had an allowable degree of uniformity. When the polyester film sheet S covered the entire splashing range, even the uniformity of image density was not acceptable. The omission of the peripheral portion of a text image, as well as the residual image, was conspicuous without regard to the presence/absence of the polyester film sheet S. The amount of free toner grains T was 43% of the total amount of development of an image portion.

Example 3 estimated an amount of free toner grains making an image acceptable by comparing it with the amount of development of an image portion. In Example 3, the toner content of the developer was 7 wt % as in Example 2 while the polyester film sheet S covered part of the splashing range to implement an amount of free toner grains T of 0.35 mg/cm$^2$. The amount of free grains T was found to be 50% of the total amount of development of an image portion. A residual image in a halftone image was acceptable.

EXAMPLES 4 AND 5 AND COMPARATIVE EXAMPLES 4 AND 5

Carrier grains had a mean grain size of 35 μm while the toner grains T had a mean grain size of 5 μm and was produced by polymerization. The image forming apparatus described previously was used to estimate a relation between the amount of free toner grains T and the residual image in a halftone portion. FIG. 17 lists process conditions used for the estimation while FIG. 18 lists the results of estimation. As shown, the effect of free toner grains T in Example 4 had the same tendency as in Examples 2 and 3. In Example 4, a developing gap PG and a doctor gap DG were selected to be 0.4 mm and 0.5 mm, respectively, because the carrier grains C had a small grain size. The potential for development was 250 V while the toner content of the developer was 9 wt %.

In Example 4, although the amount of toner grains developed an image portion was 0.5 mg/cm$^2$, it implemented sufficient image density. No residual images appeared in a halftone portion. The amount of free toner grains T was 90% of the total amount of development of an image portion. In Example 4, when the polyester film sheet S covered the entire plashing range, the uniformity of image density was lowered to bring about a residual image in a halftone portion and the omission of the peripheral portion of a text image.

Example 5 was identical with Example 3 except that the toner content of the developer was increased to 11 wt %, and that the amount of free toner grains was selected to be 0.7 mg/cm$^2$. Also, the potential for development was varied to 200 V in order to implement an amount of toner grains for development of 5 mg/cm$^2$. Example 5 realized sufficient image density and caused no residual images to appear in a halftone portion. The amount of free toner grains T was 140% of the total amount of development of an image portion. Even an amount of free toner grains T of 150% maintained high image quality. However, when the polyester film sheet S covered the entire splashing range, the uniformity of image density was lowered and brought about a residual image and the omission of the peripheral portion of a text image.

EXAMPLE 6 AND COMPARATIVE EXAMPLES 6, 7 AND 8

The carrier grains had a mean grain size of 35 μm while the toner grains T had a mean particle size of 5 μm and was produced by polymerization. The image forming apparatus described previously was used to determine a relation between the amount of free toner grains T and the contamination of the background of an image. FIG. 19 lists developers and process conditions used for estimation while FIG. 20 lists the results of estimation.

As shown in FIG. 19, Example 6 further increased the amount of free toner grains T and examined images by increasing the speed of the sleeve 111 such that the ratio Vs/Vp was 1.9. Also, the doctor gap was increased to increase the amount of free toner grains T. The toner content of the developer was reduced to 8 wt % for implementing an amount of toner grains for development of 0.5 mg/cm$^2$. The potential for development was lowered to 185 V. In these conditions, the amount of free toner grains T was found to be 0.98/cm$^2$ and therefore 196% of the total amount of development of an image portion. No defects except for some background contamination were observed.

In Comparative Example 6, when the polyester film sheet S covered the entire splashing range, the peripheral portion of a text image was lost although image density and residual image in a halftone portion changed little. Amounts of free toner grains T up to 200% were acceptable.

Comparative Examples 7 and 8 further increased the toner content of the developer to 9 wt % and lowered the potential for development to 175 V to implement the amount of toner grains for development of 0.5 mg/cm$^2$. When the amount of free toner grains T was 220% of the total amount of development of an image portion, background contamination was critical and exceeded an allowable level.

As stated above, in Examples 1 through 6, the free toner grains T parted from the brush chains deposit on a latent image by 50% to 200%, preferably 80% to 150%, of the entire toner grains deposited on the latent image moved away from the developing zone in terms of weight. This successfully prevents the toner grains T of the brush chains to effect at least an image during development and thereby obviates defects, e.g., a residual image ascribable to the contamination of the sleeve 111.

Second Embodiment

Figure 21A:
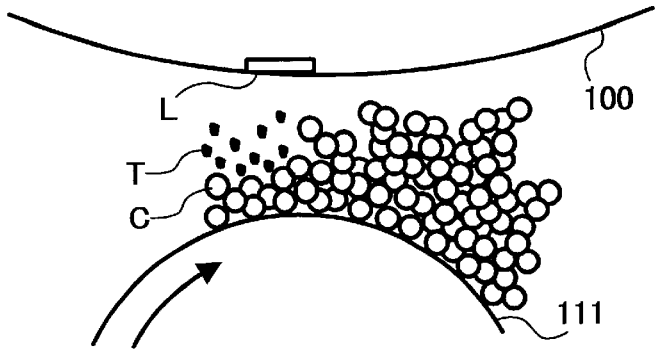
FIG. 21A shows a condition in which free toner grains appear in a non-contact developing system.
Figure 21B:
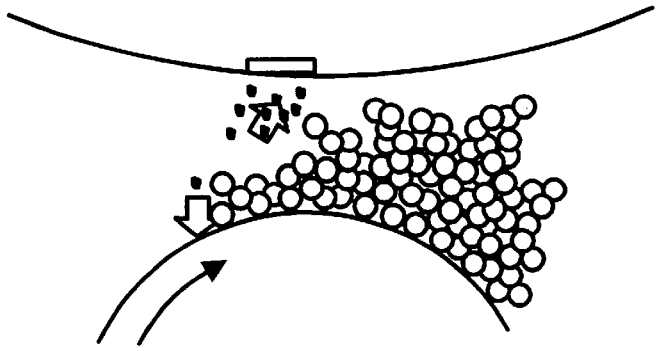
FIG. 21B shows a condition in which the free toner grains are flying toward a latent image.
Figure 21C:
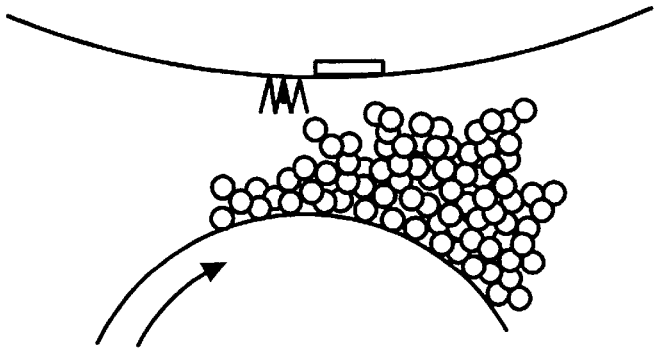
FIG. 21C shows a condition in which the free toner grains are oscillating between the tips of brush chains and an image carrier.

A specific non-contact type developing system will be described with reference to FIGS. 21A through 21C. FIG. 21A shows a condition wherein the free toner grains T part from the carrier grains C. FIG. 21B shows a condition wherein the free toner grains T are moving toward the latent image L formed on the drum 100. FIG. 21C shows a condition wherein the free toner grains T are oscillating between the tips of brush chains and the drum 100.

In the illustrative embodiment, the drum 100 moves at a linear velocity of 240 mm/sec while the sleeve 100 has an outside diameter 200 mm and moves at a linear velocity of 600 mm/sec. The ratio Vs/Vp is therefore 2.5. Grooves, not shown, are formed in the surface of the sleeve 111 for scooping up a sufficient amount of developer and regulating the shape of brush chains. To form the grooves, use may be made of any one of conventional technologies including cutting, pultrusion and sand-blasting. The gap for development between the drum 100 and the sleeve 111 is 0.45 mm. This gap should preferably be 0.65 mm or less when the carrier grain size is 50 $\mu$m, i.e., thirteen times of the carrier grain size or less. If the gap is excessively small, then a mechanical force will cause the free toner grains T to deposit on the drum 100 at the moment when the brush chains start rising, contaminating the background of an image.

As for a contact type developing method that causes a magnet brush to contact the drum 100 over a broad range, the thickening of horizontal lines, the omission of a trailing edge and other defects dependent on direction are apt to occur. Conversely, when the gap for development is increased, the field strength is short and brings about defects including irregularity in solitary dots and solid portions. While the bias for development may be increased to maintain sufficient field strength, a high bias translates into wasteful power consumption and defects including white spots ascribable to discharge.

A doctor blade or metering member, not shown, is positioned upstream of the developing zone in the direction of developer conveyance (clockwise in FIGS. 21A through 21C), as stated earlier. In the illustrative embodiment, the doctor gap between the doctor blade and the sleeve 111 is selected to be 0.3 mm. The doctor gap should preferably be two times as great as the carrier grain size or above, so that a sufficient amount of free toner grains T can be produced without aggravating carrier deposition and other problems.

FIG. 22 lists experimental results showing a relation between the doctor cap, the carrier grain size and the gap for development. In FIG. 22, DG and PG denote the doctor gap and gap for development, respectively. Experiments were conducted with a carrier grain size of 50 $\mu$m and an electric field of $810^5$ V/m in a solid image portion.

As FIG. 22 indicates, if the doctor gap DG is excessively small, then the carrier grains cannot smoothly pass through the gap DG and make the amount of developer at the nip irregular. Further, brush chains do not actively move at the time of rise and therefore limit the amount of free toner grains T to appear, lowering image density in a black solid portion. On the other hand, an excessively great doctor gap DG brings about various problems including carrier deposition.

Stated another way, when the doctor gap DG is less than two times the carrier grain size, an amount of carrier grains C great enough to form brush chains does not exist in the developing zone. As a result, the amount of free toner grains T to appear when brush chains start rising on the sleeve 111 is reduced. An excessively great doctor gap DG causes the developer to contact the drum 100 before reaching the developing zone, preventing a cloud-like toner mass from being produced. While the doctor blade has customarily been implemented as a plate of nonmagnetic material, the doctor blade included in this specific configuration is implemented as a plate of magnetic material and adhered to the conventional nonmagnetic plate. The magnetic material readily provides the brush chains with substantially the same height.

The main pole P1 has a peak magnetic force located at the position M1 in the direction normal to the sleeve 111, as stated previously. A magnet roller has magnets arranged such that the above position M1 is positioned downstream of the position M0 where the sleeve 111 is closest to the drum 100 in the direction of movement of the drum 100 (counterclockwise). Stated another way, the peak position M1 is shifted from the position M0 by 0 degree to 30 degrees. This locates as great part of the range where the free toner grains T appear at the initial stage as possible in the range where the grains T can move toward the latent image L. The brush chains rise at or around the position M0 or the skirt portion of the magnetic lines of force of the main pole P1 at the upstream side. Most of the free toner grains T forming cloud or smoke easily move toward the latent image L because of the electric field for development.

FIG. 23 shows experimental results obtained by varying the angle θ between the positions M0 and M1. For experiments, a solitary dot image (600 dpi dots) and a lattice-like dot image (600 dpi; 1 cm square) were output and estimated. The carrier grains C had a mean grain size of 50 $\mu$m and magnetization strength of 60 emu/g. The toner grains T had a mean grain size of 7 $\mu$m. The developer had a toner content of 4 wt %. The toner grains T were charged to −22.5 $\mu$C/g. As for process conditions, the charge potential was −700 V while potentials in an image portion and a non-image portion were −100 V and −650 V, respectively. The bias for development was implemented by an alternating electric field formed by a DC −500 V on which a rectangular wave with a voltage of 1,000 Vpp (peak-to-peak) and a frequency of 2 kH was superposed. As FIG. 23 indicates, the illustrative embodiment maintains the developing ability higher than the conventional conditions.

The above advantage is also achievable when the magnet of the magnet roller is adjusted so as to locate the position M0 between the position M1 and a position where the flux density is zero between the main magnet P1 and the magnet P6 upstream of the main magnet P1. In Comparative Example 9, image quality was desirable although a black solid portion had low density due to zero angle θ. It will therefore be seen that by increasing the toner content and therefore the amount of free toner grains, it is possible to increase the image density of a black solid portion.

In the illustrative embodiment, the carrier grains C have magnetization strength of 90 emu/g or below, preferably 60 emu/g or below, in a magnetic field of 1 kOe. FIG. 24 shows experimental results indicative of a relation between the magnetization strength of the carrier grains C and image quality. Experiments were conducted with carrier grains having a mean grain size of 50 $\mu$m. As shown, excessively great magnetization strength makes the brush chains too high, thin and hard to effect non-contact development. In addition, it is difficult to regulate the height of the brush chains.

On the other hand, magnetization strength great enough to prevent the carrier grains C from moving away from the main pole P1 due to a centrifugal force is necessary. More specifically, when magnetization strength is excessively small, the magnet fails to sufficiently retain the carrier grains C and causes them to fly away. The carrier grains C should preferably be spherical in order to reduce damage to the drum 100. The mean grain size of the carrier grains C should be 20 μm or above, but 10 μm or below, preferably 25 μm or above, but 50 μm or below.

FIG. 25 shows experimental results indicative of a relation between the carrier grain size and image quality. As shown, an excessively great mean grain size reduces the surface area of the individual carrier grain and limits the amount of free toner grains T. This is problematic when it comes to a solid image. In the case of an AC voltage, an excessively small mean grain size causes the carrier grains to easily move and fly about by overcoming a magnetic force acting between the grains. This results in carrier deposition and therefore white spots.

Third Embodiment

This embodiment pertains to contact type development and is identical with the second embodiment as to the position of the main pole P1 with respect to the position M0.

Figure 26A:
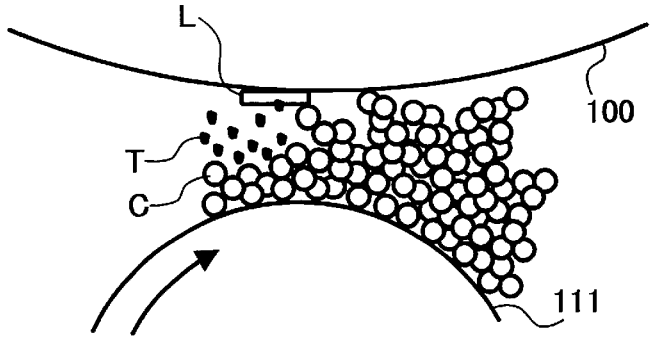
FIG. 26A shows a condition in which free toner grains appear in a contact developing system.
Figure 26B:
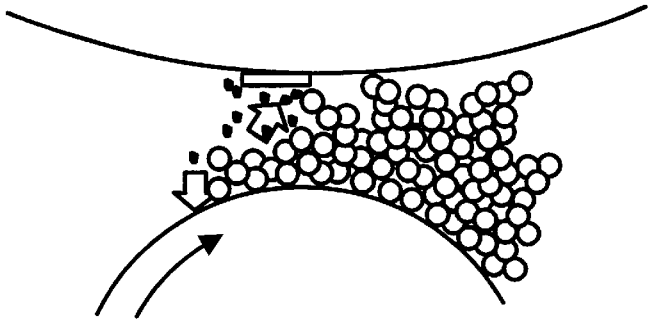
FIG. 26B shows a condition in which the free toner grains are flying toward a latent image.
Figure 26C:
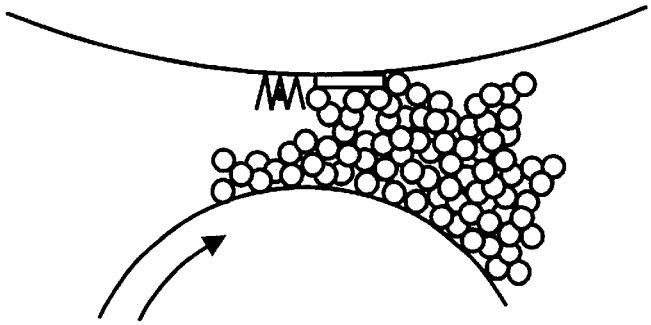
FIG. 26C shows a condition in which the free toner grains are oscillating between the tips of brush chains and an image carrier.

FIG. 26A shows the free toner grains T produced on the rise of the brush chains during contact development. FIG. 26B shows the free toner grains T flying toward the latent image L. FIG. 26C shows the free toner grains T oscillating between the tips of the brush chains and the drum 100. As shown, the brush chains contact the drum 100 at the downstream side (outlet side) of the developing zone. In this condition, the electrode effect acts between the carrier grains C on the tips of the brush chains and the drum 100. The electrode effect further uniforms a toner layer in an image portion while efficiently scavenging toner grains deposited in a non-image portion. This is also true when a DC bias is used for development.

Further, the illustrative embodiment reduces the duration of contact of the brush chains with the drum 100 and thereby obviates the direction-dependent defective images, compared to the conventional developing system using the toner and carrier mixture.

FIGS. 27 through 29 show tables corresponding to the tables of FIGS. 23 through 25 and will not be described specifically.

In summary, it will be seen that the present invention provides a developing device and an image forming apparatus having various unprecedented advantages, as enumerated below.

(1) A developing zone broader than conventional one increases the amount of toner available for development in the developing zone. A solid image portion therefore achieves high image density.

(2) On contacting an image carrier, carrier grains forming brush chains remove toner grains deposited on the image carrier with their tips. This insures high image quality by rendering a smooth solid image portion, protecting a non-image portion from fog, and faithfully reproducing horizontal lines and characters.

The brush chains do not affect an image even if the amount of toner grains deposited thereon is small. This obviates defects including a residual image ascribable to the contamination of a developer carrier. More specifically, the movement of toner grains deposited on the brush chains toward the developer carrier is obstructed, so that the contamination of the image carrier and the residual image of a halftone image are obviated.

(4) The broad developing zone increases the amount of toner grains available for development without the rotation of the developer carrier being accelerated.

(5) Further, the increased amount of toner grains available for development broadens the allowable range of a gap for development and that of the speed of the developer carrier in the event of machine designing.

Various modifications will become possible for those skilled in the art after receiving the teachings of the present disclosure without departing from the scope thereof.

What is claimed is:

1. A method of developing a latent image formed on an image carrier with a two-ingredient type developer consisting of toner grains and magnetic carrier grains for supporting said toner grains, said method comprising the steps of:

preparing a developer carrier facing said image carrier and accommodating magnetic field forming means therein for causing the two-ingredient type developer to deposit on said developer carrier;

conveying the developer to a developing zone formed between said image carrier and said developer carrier; and developing the latent image with a magnet brush including free toner grains, which part from brush chains formed by the carrier grains when said brush chains start rising on said developer carrier in said developing zone.

2. The method as claimed in claim 1, wherein the latent image is developed by movement of the toner grains from said carrier grains to said image carrier and movement of said toner grains from said image carrier to said carrier grains.

3. The method as claimed in claim 2, wherein said free toner grains deposit on the latent image by an amount of 50% to 200% of a total amount of toner grains deposited on the latent image moved away from said developing zone.

4. The method as claimed in claim 3, wherein said free toner grains deposit on the latent image by an amount of 80% to 150% of a total amount of toner grains deposited on the latent image moved away from said developing zone.

5. The method as claimed in claim 4, wherein a range in which said free toner grains part from the brush chains is coincident with a range in which said free toner grains are movable toward the latent image.

6. The method as claimed in claim 5, wherein said magnetic field forming means adjusts the range in which said free toner grains part from the brush chains.

7. The method as claimed in claim 6, wherein the range in which said free toner grains part from the brush chains is located upstream, in a direction of developer conveyance, of a position where said image carrier and said developer carrier are closest to each other.

8. The method as claimed in claim 6, wherein the range in which said free toner grains part from the brush chains is a range including a position where said image carrier and said developer carrier are closest to each other.

9. The method as claimed in claim 8, wherein the magnet brush rubs against said image carrier.

10. The method as claimed in claim 8, wherein the magnet brush does not contact said image carrier.

11. The method as claimed in claim 10, wherein at least one of a DC electric field and an AC electric field is formed between the magnet brush and said image carrier.

12. The method as claimed in claim 11, wherein the carrier grains have magnetization strength of 90 emu/g or below.

13. The method as claimed in claim 12, wherein the carrier grains have a volume mean grain size of 20 μm to 100 μm.

14. The method as claimed in claim 1, wherein said free toner grains deposit on the latent image by an amount of 50% to 200% of a total amount of toner grains deposited on the latent image moved away from said developing zone.

15. The method as claimed in claim 14, wherein said free toner grains deposit on the latent image by an amount of 80% to 150% of a total amount of toner grains deposited on the latent image moved away from said developing zone.

16. The method as claimed in claim 15, wherein a range in which said free toner grains part from the brush chains is coincident with a range in which said free toner grains are movable toward the latent image.

17. The method as claimed in claim 16, wherein said magnetic field forming means adjusts the range in which said free toner grains part from the brush chains.

18. The method as claimed in claim 17, wherein the range in which said free toner grains part from the brush chains is located upstream, in a direction of developer conveyance, of a position where said image carrier and said developer carrier are closest to each other.

19. The method as claimed in claim 17, wherein the range in which said free toner grains part from the brush chains is a range including a position where said image carrier and said developer carrier are closest to each other.

20. The method as claimed in claim 19, wherein the magnet brush rubs against said image carrier.

21. The method as claimed in claim 19, wherein the magnet brush does not contact said image carrier.

22. The method as claimed in claim 21, wherein at least one of a DC electric field and an AC electric field is formed between the magnet brush and said image carrier.

23. The method as claimed in claim 22, wherein the carrier grains have magnetization strength of 90 emu/g or below.

24. The method as claimed in claim 23, wherein the carrier grains have a volume mean grain size of 20 μm to 100 μm.

25. The method as claimed in claim 1, wherein a range in which said free toner grains part from the brush chains is coincident with a range in which said free toner grains are movable toward the latent image.

26. The method as claimed in claim 25, wherein said magnetic field forming means adjusts the range in which said free toner grains part from the brush chains.

27. The method as claimed in claim 26, wherein the range in which said free toner grains part from the brush chains is located upstream, in a direction of developer conveyance, of a position where said image carrier and said developer carrier are closest to each other.

28. The method as claimed in claim 26, wherein the range in which said free toner grains part from the brush chains is a range including a position where said image carrier and said developer carrier are closest to each other.

29. The method as claimed in claim 28, wherein the magnet brush rubs against said image carrier.

30. The method as claimed in claim 28, wherein the magnet brush does not contact said image carrier.

31. The method as claimed in claim 30, wherein at least one of a DC electric field and an AC electric field is formed between the magnet brush and said image carrier.

32. The method as claimed in claim 31, wherein the carrier grains have magnetization strength of 90 emu/g or below.

33. The method as claimed in claim 32, wherein the carrier grains have a volume mean grain size of 20 μm to 100 μm.

34. The method as claimed in claim 1, wherein said magnetic field forming means adjusts the range in which said free toner grains part from the brush chains.

35. The method as claimed in claim 34, wherein the range in which said free toner grains part from the brush chains is located upstream, in a direction of developer conveyance, of a position where said image carrier and said developer carrier are closest to each other.

36. The method as claimed in claim 35, wherein the range in which said free toner grains part from the brush chains is a range including a position where said image carrier and said developer carrier are closest to each other.

37. The method as claimed in claim 36, wherein the magnet brush rubs against said image carrier.

38. The method as claimed in claim 36, wherein the magnet brush does not contact said image carrier.

39. The method as claimed in claim 38, wherein at least one of a DC electric field and an AC electric field is formed between the magnet brush and said image carrier.

40. The method as claimed in claim 39, wherein the carrier grains have magnetization strength of 90 emu/g or below.

41. The method as claimed in claim 40, wherein the carrier grains have a volume mean grain size of 20 μm to 100 μm.

42. The method as claimed in claim 1, wherein the magnet brush rubs against said image carrier.

43. The method as claimed in claim 1, wherein the magnet brush does not contact said image carrier.

44. The method as claimed in claim 43, wherein at least one of a DC electric field and an AC electric field is formed between the magnet brush and said image carrier.

45. The method as claimed in claim 44, wherein the carrier grains have magnetization strength of 90 emu/g or below.

46. The method as claimed in claim 45, wherein the carrier grains have a volume mean grain size of 20 μm to 100 μm.

47. The method as claimed in claim 1, wherein at least one of a DC electric field and an AC electric field is formed between the magnet brush and said image carrier.

48. The method as claimed in claim 47, wherein the carrier grains have magnetization strength of 90 emu/g or below.

49. The method as claimed in claim 48, wherein the carrier grains have a volume mean grain size of 20 μm to 100 μm.

50. The method as claimed in claim 1, wherein the carrier grains have magnetization strength of 90 emu/g or below.

51. The method as claimed in claim 50, wherein the carrier grains have a volume mean grain size of 20 μm to 100 μm.

52. The method as claimed in claim 1, wherein the carrier grains have a volume mean grain size of 20 μm to 100 μm.

53. In a device for developing a latent image formed on an image carrier with a two-ingredient type developer consisting of toner grains and magnetic carrier grains for supporting said toner grains, said device comprising:

a developer carrier facing the image carrier for causing the two-ingredient type developer to deposit on said developer carrier; and conveying means for conveying the developer to a developing zone formed between the image carrier and said developer carrier;

wherein the latent image is developed by a magnet brush including free toner grains, which part from brush chains formed by the carrier grains when said brush chains start rising on said developer carrier in said developing zone.

54. The device as claimed in claim 53, wherein the latent image is developed by movement of the toner grains from said carrier grains to the image carrier and movement of said toner grains from said image carrier to said carrier grains.

55. The device as claimed in claim 54, wherein said free toner grains deposit on the latent image by an amount of 50% to 200% of a total amount of toner grains deposited on the latent image moved away from said developing zone.

56. The device as claimed in claim 54, wherein said free toner grains deposit on the latent image by an amount of 80% to 150% of a total amount of toner grains deposited on the latent image moved away from said developing zone.

57. The method as claimed in claim 54, further comprising magnetic field forming means accommodated in said developer carrier for adjusting a range in which said free toner grains part from the brush chains.

58. The device as claimed in claim 53, wherein said free toner grains deposit on the latent image by an amount of 50% to 200% of a total amount of toner grains deposited on the latent image moved away from said developing zone.

59. The device as claimed in claim 53, wherein said free toner grains deposit on the latent image by an amount of 80% to 150% of a total amount of toner grains deposited on the latent image moved away from said developing zone.

60. The method as claimed in claim 53, further comprising magnetic field forming means accommodated in said developer carrier for adjusting a range in which said free toner grains part from the brush chains.

61. An image forming apparatus comprising:

an image carrier for forming a latent image thereon;

a developing device including a developer carrier facing said image carrier and accommodating magnetic field forming means therein for developing the latent image with a two-ingredient type developer, which consists of toner grains and carrier grains for supporting said toner grains; and conveying means for conveying the developer to a developing zone formed between said image carrier and said developer carrier;

wherein the latent image is developed by a magnet brush including free toner grains, which part from brush chains formed by the carrier grains when said brush chains start rising on said developer carrier in said developing zone.

62. The device as claimed in claim 61, wherein the latent image is developed by movement of the toner grains from said carrier grains to the image carrier and movement of said toner grains from said image carrier to said carrier grains.

63. The device as claimed in claim 62, wherein said free toner grains deposit on the latent image by an amount of 50% to 200% of a total amount of toner grains deposited on the latent image moved away from said developing zone.

64. The device as claimed in claim 62, wherein said free toner grains deposit on the latent image by an amount of 80% to 150% of a total amount of toner grains deposited on the latent image moved away from said developing zone.

65. The device as claimed in claim 61, wherein said free toner grains deposit on the latent image by an amount of 50% to 200% of a total amount of toner grains deposited on the latent image moved away from said developing zone.

66. The device as claimed in claim 61, wherein said free toner grains deposit on the latent image by an amount of 80% to 150% of a total amount of toner grains deposited on the latent image moved away from said developing zone.

* * * * *